US009127546B2

(12) United States Patent
Quigley et al.

(10) Patent No.: US 9,127,546 B2
(45) Date of Patent: Sep. 8, 2015

(54) DOWNHOLE FLUID SEPARATION

(75) Inventors: Peter A. Quigley, Duxbury, MA (US); Michael Feechan, Katy, TX (US)

(73) Assignee: FIBERSPAR COPROATION, New Bedford, MA (US)

( * ) Notice: Subject to any disclaimer, the term of this patent is extended or adjusted under 35 U.S.C. 154(b) by 272 days.

(21) Appl. No.: 12/692,142

(22) Filed: Jan. 22, 2010

(65) Prior Publication Data

US 2010/0218944 A1 Sep. 2, 2010

Related U.S. Application Data

(60) Provisional application No. 61/146,785, filed on Jan. 23, 2009.

(51) Int. Cl.

| | |
|---|---|
| ***E21B 17/02*** | (2006.01) |
| ***E21B 43/38*** | (2006.01) |
| ***E21B 17/20*** | (2006.01) |
| ***E21B 43/12*** | (2006.01) |

(52) U.S. Cl.

CPC ..... *E21B 43/385* (2013.01); *E21B 17/20* (2013.01); *E21B 43/12* (2013.01)

(58) Field of Classification Search

CPC ..... E21B 17/02; E21B 17/03; E21B 33/12; E21B 33/128; E21B 33/1208; E21B 33/126; E21B 33/1277; E21B 43/26

USPC ..... 166/105.5, 68, 265, 242.6; 417/423.3

See application file for complete search history.

(56) References Cited

U.S. PATENT DOCUMENTS

| | | | |
|---|---|---|---|
| 87,993 | A | 3/1869 | Watson |
| 142,388 | A | 9/1873 | Goble |
| 396,176 | A | 1/1889 | Simpson |
| 418,906 | A | 1/1890 | Bosworth |
| 482,181 | A | 9/1892 | Kellom |
| 646,887 | A | 4/1900 | Stowe et al. |
| 749,633 | A | 1/1904 | Seeley |
| 1,234,812 | A | 7/1917 | Simmons |
| 1,793,455 | A | 2/1931 | Buchanan |
| 1,890,290 | A | 12/1932 | Hargreaves |
| 1,930,285 | A | 10/1933 | Robinson |

(Continued)

FOREIGN PATENT DOCUMENTS

| | | |
|---|---|---|
| BE | 559688 | 8/1957 |
| CA | 2282358 A1 | 8/1998 |

(Continued)

OTHER PUBLICATIONS

International Search Report mailed on Jan. 22, 2001.

(Continued)

*Primary Examiner* — David Bagnell
*Assistant Examiner* — Ronald Runyan
(74) *Attorney, Agent, or Firm* — Goodwin Procter LLP

(57) ABSTRACT

The invention includes systems and methods for operating, monitoring and controlling downhole fluid control system at a below ground location in a wellhole. The system may include a downhole fluid control system comprising at least one pump, a spoolable composite pipe comprising a fluid channel and at least one energy conductor, and a distal connection device adapted to couple a distal end of the fluid channel to the at least one pump and couple a distal end of the at least one energy conductor to the downhole fluid control system.

18 Claims, 10 Drawing Sheets

(56) References Cited

U.S. PATENT DOCUMENTS 2,099,407 A 11/1937 Raymond
2,178,931 A 11/1939 Crites
2,464,416 A 3/1949 Raybould
2,467,520 A 4/1949 Brubaker
2,481,001 A 9/1949 Burckle
2,624,366 A 1/1953 Pugh
2,648,720 A 8/1953 Alexander
2,690,769 A 10/1954 Brown
2,725,713 A 12/1955 Blanchard
2,742,931 A 4/1956 De Ganahl
2,750,569 A 6/1956 Moon
2,810,424 A 10/1957 Swartswelter at al.
2,969,812 A 1/1961 De Ganahl
2,973,975 A 3/1961 Ramberg et al.
2,991,093 A 7/1961 Guarnaschelli
3,086,369 A 4/1963 Brown
3,116,760 A 1/1964 Matthews
3,167,125 A * 1/1965 Bryan ..... 166/306
3,170,137 A 2/1965 Brandt
3,212,528 A 10/1965 Haas
3,277,231 A 10/1966 Downey at al.
3,306,637 A 2/1967 Press at al.
3,334,663 A 8/1967 Peterson
3,354,292 A 11/1967 Kahn
3,379,220 A 4/1968 Kiuchi at al.
3,383,223 A 5/1968 Rose
3,390,704 A 7/1968 Woodell
3,413,169 A 11/1968 Krings
3,459,229 A 8/1969 Croft
3,477,474 A 11/1969 Mesler
3,507,412 A 4/1970 Carter
3,522,413 A 8/1970 Chrow
3,526,086 A 9/1970 Morgan
3,554,284 A 1/1971 Nystrom
3,563,825 A 2/1971 Segura
3,579,402 A 5/1971 Goldsworthy et al.
3,589,135 A 6/1971 Ede
3,589,752 A 6/1971 Spencer et al.
3,604,461 A 9/1971 Matthews
3,606,396 A 9/1971 Prosdocimo at al.
3,606,402 A 9/1971 Medney
3,612,580 A 10/1971 Jones
3,654,967 A 4/1972 Atwell et al.
3,677,978 A 7/1972 Dowbenko et al.
3,685,860 A 8/1972 Schmidt
3,692,601 A 9/1972 Goldsworthy et al.
3,696,332 A 10/1972 Dickson, Jr. et al.
3,700,519 A 10/1972 Carter
3,701,489 A 10/1972 Goldsworthy et al.
3,728,187 A 4/1973 Martin
3,730,229 A 5/1973 D'Onofrio
3,734,421 A 5/1973 Karlson et al.
3,738,637 A 6/1973 Goldsworthy et al.
3,740,285 A 6/1973 Goldsworthy et al.
3,744,016 A 7/1973 Davis
3,769,127 A 10/1973 Goldsworthy et al.
3,773,090 A 11/1973 Ghersa et al.
3,776,805 A 12/1973 Hansen
3,783,060 A 1/1974 Goldsworthy et al.
3,790,438 A 2/1974 Lewis et al.
3,814,138 A 6/1974 Courtot
3,817,288 A 6/1974 Ball
3,828,112 A 8/1974 Johansen et al.
3,856,052 A 12/1974 Feucht
3,858,616 A 1/1975 Thiery et al.
3,860,040 A 1/1975 Sullivan
3,860,742 A 1/1975 Medney
3,866,633 A 2/1975 Taylor
3,901,281 A 8/1975 Morrisey
3,907,335 A 9/1975 Burge et al.
3,913,624 A 10/1975 Ball
3,932,559 A 1/1976 Cantor et al.
3,933,180 A 1/1976 Carter
3,955,601 A 5/1976 Plummer, III
3,956,051 A 5/1976 Carter
3,957,410 A 5/1976 Goldsworthy et al.
3,960,629 A 6/1976 Goldsworthy
3,963,377 A 6/1976 Elliott et al.
3,974,862 A 8/1976 Fuhrmann et al.
3,980,325 A 9/1976 Robertson
RE29,112 E 1/1977 Carter
4,001,442 A 1/1977 Stahlberger et al.
4,007,070 A 2/1977 Busdiecker
4,013,101 A 3/1977 Logan et al.
4,032,177 A 6/1977 Anderson
4,048,807 A 9/1977 Ellers et al.
4,053,343 A 10/1977 Carter
4,057,610 A 11/1977 Goettler et al.
4,067,916 A 1/1978 Jaeger et al.
4,095,865 A 6/1978 Denison et al.
4,104,095 A 8/1978 Shaw
4,108,701 A 8/1978 Stanley
4,111,237 A 9/1978 Mutzner et al.
4,111,469 A 9/1978 Kavick
4,114,393 A 9/1978 Engle, Jr. et al.
4,119,122 A 10/1978 de Putter
4,125,423 A 11/1978 Goldsworthy
4,133,972 A 1/1979 Andersson et al.
4,137,949 A 2/1979 Linko, III et al.
4,138,178 A 2/1979 Miller et al.
4,139,025 A 2/1979 Carlstrom et al.
4,148,963 A 4/1979 Bourrain et al.
4,190,088 A 2/1980 Lalikos et al.
4,196,307 A 4/1980 Moore et al.
4,200,126 A 4/1980 Fish
4,220,381 A 9/1980 van der Graaf et al.
4,226,446 A 10/1980 Burrington
4,229,613 A 10/1980 Braun
4,241,763 A 12/1980 Antal et al.
4,241,787 A * 12/1980 Price ..... 166/105
4,248,062 A 2/1981 McLain et al.
4,261,390 A 4/1981 Belofsky
4,273,160 A 6/1981 Lowles
4,303,263 A 12/1981 Legris
4,303,457 A 12/1981 Johansen et al.
4,306,591 A 12/1981 Arterburn
4,307,756 A 12/1981 Voigt et al.
4,308,999 A 1/1982 Carter
4,330,017 A 5/1982 Satoh et al.
4,336,415 A 6/1982 Walling
4,345,784 A * 8/1982 Walling ..... 285/39
4,351,364 A 9/1982 Cocks et al.
4,380,252 A 4/1983 Gray et al.
4,385,644 A 5/1983 Kaempen
4,402,346 A 9/1983 Cheetham et al.
4,417,603 A 11/1983 Argy
4,421,806 A 12/1983 Marks et al.
4,422,801 A 12/1983 Hale et al.
4,434,816 A 3/1984 Di Giovanni et al.
4,445,734 A 5/1984 Cunningham
4,446,892 A 5/1984 Maxwell et al.
4,447,378 A 5/1984 Gray et al.
4,463,779 A 8/1984 Wink et al.
4,469,729 A 9/1984 Watanabe et al.
4,476,923 A * 10/1984 Walling ..... 166/66.4
4,488,577 A 12/1984 Shilad et al.
4,507,019 A 3/1985 Thompson
4,515,737 A 5/1985 Karino et al.
4,522,058 A 6/1985 Ewing
4,522,235 A 6/1985 Kluss et al.
4,530,379 A 7/1985 Policelli
4,556,340 A 12/1985 Morton
4,567,916 A 2/1986 Antal et al.
4,578,675 A 3/1986 MacLeod
4,606,378 A 8/1986 Meyer et al.
4,627,472 A 12/1986 Goettler et al.
4,652,475 A 3/1987 Haney et al.
4,657,795 A 4/1987 Foret et al.
4,676,563 A * 6/1987 Curlett et al. ..... 439/194
4,681,169 A 7/1987 Brookbank, III
4,700,751 A 10/1987 Fedrick
4,706,711 A 11/1987 Czvikovszky et al.
4,712,813 A 12/1987 Passerell et al.
4,728,224 A 3/1988 Salama et al.

(56) References Cited

U.S. PATENT DOCUMENTS 4,729,106 A 3/1988 Rush et al.
4,741,795 A 5/1988 Grace et al.
4,758,455 A 7/1988 Campbell et al.
4,789,007 A 12/1988 Cretel et al.
4,842,024 A 6/1989 Palinchak
4,844,516 A 7/1989 Baker
4,849,668 A 7/1989 Crawley et al.
4,854,349 A 8/1989 Foreman
4,859,024 A 8/1989 Rahman
4,869,293 A 9/1989 Botsolas
4,903,735 A 2/1990 Delacour et al.
4,913,657 A 4/1990 Naito et al.
4,936,618 A 6/1990 Sampa et al.
4,941,774 A 7/1990 Harmstorf et al.
4,942,903 A 7/1990 Jacobsen et al.
4,972,880 A 11/1990 Strand
4,992,787 A 2/1991 Helm
4,995,761 A 2/1991 Barton
5,024,252 A 6/1991 Ochsner
5,048,572 A 9/1991 Levine
5,072,622 A 12/1991 Roach et al.
5,077,107 A 12/1991 Kaneda et al.
5,080,560 A 1/1992 LeRoy et al.
5,090,741 A 2/1992 Yokomatsu et al.
5,097,870 A 3/1992 Williams
5,123,453 A 6/1992 Robbins
5,156,206 A 10/1992 Cox
5,170,011 A 12/1992 Martucci
5,172,765 A 12/1992 Sas-Jaworsky et al.
5,176,180 A 1/1993 Williams et al.
5,182,779 A 1/1993 D'Agostino et al.
5,184,682 A 2/1993 Delacour et al.
5,188,872 A 2/1993 Quigley
5,209,136 A 5/1993 Williams
5,222,769 A 6/1993 Kaempen
5,257,663 A * 11/1993 Pringle et al. ..... 166/66.4
5,261,462 A 11/1993 Wolfe et al.
5,265,648 A 11/1993 Lyon
5,285,008 A 2/1994 Sas-Jaworsky et al.
5,285,204 A 2/1994 Sas-Jaworsky
5,330,807 A 7/1994 Williams
5,332,269 A 7/1994 Homm
5,334,801 A 8/1994 Mohn et al.
5,343,738 A 9/1994 Skaggs
5,346,658 A 9/1994 Gargiulo
5,348,088 A 9/1994 Laflin et al.
5,348,096 A 9/1994 Williams
5,351,752 A 10/1994 Wood et al.
RE34,780 E 11/1994 Trenconsky et al.
5,364,130 A 11/1994 Thalmann
5,373,870 A 12/1994 Derroire et al.
5,394,488 A 2/1995 Fernald et al.
5,395,913 A 3/1995 Bottcher et al.
5,398,729 A 3/1995 Spurgat
5,400,602 A 3/1995 Chang et al.
5,416,724 A 5/1995 Savic
5,423,353 A 6/1995 Sorensen
5,426,297 A 6/1995 Dunphy et al.
5,428,706 A 6/1995 Lequeux et al.
5,435,867 A 7/1995 Wolfe et al.
5,437,311 A 8/1995 Reynolds
5,437,899 A 8/1995 Quigley
5,443,099 A 8/1995 Chaussepied et al.
5,452,923 A 9/1995 Smith
5,460,416 A 10/1995 Freidrich et al.
RE35,081 E 11/1995 Quigley
5,469,916 A 11/1995 Sas-Jaworsky et al.
5,472,764 A 12/1995 Kehr et al.
5,494,374 A 2/1996 Youngs et al.
5,499,661 A 3/1996 Odru et al.
5,507,320 A 4/1996 Plumley
5,524,937 A 6/1996 Sides, III et al.
5,525,698 A 6/1996 Bottcher et al.
5,538,513 A 7/1996 Okajima et al.
5,551,484 A 9/1996 Charboneau
5,558,375 A 9/1996 Newman
5,622,211 A 4/1997 Martin et al.
5,641,956 A 6/1997 Vengsarkar et al.
5,671,811 A 9/1997 Head et al.
5,679,425 A 10/1997 Plumley
5,683,204 A 11/1997 Lawther et al.
5,692,545 A 12/1997 Rodrigue
5,718,956 A 2/1998 Gladfelter et al.
5,730,188 A 3/1998 Kalman et al.
5,755,266 A 5/1998 Aanonsen et al.
5,758,990 A 6/1998 Davies et al.
5,778,938 A 7/1998 Chick et al.
5,785,091 A 7/1998 Barker, II
5,795,102 A 8/1998 Corbishley et al.
5,797,702 A 8/1998 Drost et al.
5,798,155 A 8/1998 Yanagawa et al.
5,804,268 A 9/1998 Mukawa et al.
5,826,623 A 10/1998 Akiyoshi et al.
5,828,003 A 10/1998 Thomeer et al.
5,865,216 A 2/1999 Youngs
5,868,169 A 2/1999 Catallo
5,875,792 A 3/1999 Campbell, Jr. et al.
5,902,958 A 5/1999 Haxton
5,908,049 A 6/1999 Williams et al.
5,913,337 A 6/1999 Williams et al.
5,913,357 A 6/1999 Hanazaki et al.
5,921,285 A 7/1999 Quigley et al.
5,933,945 A 8/1999 Thomeer et al.
5,950,651 A 9/1999 Kenworthy et al.
5,951,812 A 9/1999 Gilchrist, Jr.
5,979,506 A 11/1999 Aarseth
5,984,581 A 11/1999 McGill et al.
5,988,702 A 11/1999 Sas-Jaworsky
6,004,639 A 12/1999 Quigley et al.
6,016,845 A 1/2000 Quigley et al.
6,032,699 A 3/2000 Cochran et al.
6,065,540 A 5/2000 Thomeer et al.
6,066,377 A 5/2000 Tonyali et al.
6,076,561 A 6/2000 Akedo et al.
6,093,752 A 7/2000 Park et al.
6,109,306 A 8/2000 Kleinert
6,123,110 A 9/2000 Smith et al.
6,136,216 A 10/2000 Fidler et al.
6,148,866 A 11/2000 Quigley et al.
RE37,109 E 3/2001 Ganelin
6,209,587 B1 4/2001 Hsich et al.
6,220,079 B1 4/2001 Taylor et al.
6,264,244 B1 * 7/2001 Isennock et al. ..... 285/55
6,286,558 B1 9/2001 Quigley et al.
6,315,002 B1 11/2001 Antal et al.
6,328,075 B1 12/2001 Furuta et al.
6,334,466 B1 1/2002 Jani et al.
6,357,485 B2 3/2002 Quigley et al.
6,357,966 B1 3/2002 Thompson et al.
6,361,299 B1 3/2002 Quigley et al.
6,372,861 B1 4/2002 Schillgalies et al.
6,390,140 B2 5/2002 Niki et al.
6,397,895 B1 6/2002 Lively
6,402,430 B1 6/2002 Guesnon et al.
6,422,269 B1 7/2002 Johansson et al.
6,461,079 B1 10/2002 Beaujean et al.
6,470,915 B1 10/2002 Enders et al.
6,532,994 B1 3/2003 Enders et al.
6,538,198 B1 3/2003 Wooters
6,557,485 B1 5/2003 Sauter et al.
6,557,905 B2 5/2003 Mack et al.
6,561,278 B2 * 5/2003 Restarick et al. ..... 166/378
6,585,049 B2 * 7/2003 Leniek, Sr. ..... 166/369
6,604,550 B2 8/2003 Quigley et al.
6,620,475 B1 9/2003 Reynolds, Jr. et al.
6,631,743 B2 10/2003 Enders et al.
6,634,387 B1 10/2003 Glejbøl et al.
6,634,388 B1 10/2003 Taylor et al.
6,634,675 B2 10/2003 Parkes
6,663,453 B2 12/2003 Quigley et al.
6,691,781 B2 2/2004 Grant et al.
6,706,348 B2 3/2004 Quigley et al.
6,706,398 B1 3/2004 Revis
6,746,737 B2 6/2004 Debalme et al.

(56) References Cited

U.S. PATENT DOCUMENTS

| | | | | |
|---|---|---|---|---|
| 6,764,365 | B2 | 7/2004 | Quigley et al. | |
| 6,773,774 | B1 | 8/2004 | Crook et al. | |
| 6,787,207 | B2 | 9/2004 | Lindstrom et al. | |
| 6,803,082 | B2 | 10/2004 | Nichols et al. | |
| 6,807,988 | B2 | 10/2004 | Powell et al. | |
| 6,807,989 | B2 | 10/2004 | Enders et al. | |
| 6,857,452 | B2 | 2/2005 | Quigley et al. | |
| 6,868,906 | B1 * | 3/2005 | Vail et al. | 166/250.01 |
| 6,889,716 | B2 | 5/2005 | Lundberg et al. | |
| 6,902,205 | B2 | 6/2005 | Bouey et al. | |
| 6,935,376 | B1 | 8/2005 | Taylor et al. | |
| 6,978,804 | B2 | 12/2005 | Quigley et al. | |
| 6,983,766 | B2 | 1/2006 | Baron et al. | |
| 7,000,644 | B2 | 2/2006 | Ichimura et al. | |
| 7,021,339 | B2 | 4/2006 | Hagiwara et al. | |
| 7,025,580 | B2 | 4/2006 | Heagy et al. | |
| 7,029,356 | B2 | 4/2006 | Quigley et al. | |
| 7,069,956 | B1 | 7/2006 | Mosier | |
| 7,080,667 | B2 | 7/2006 | McIntyre et al. | |
| 7,152,632 | B2 | 12/2006 | Quigley et al. | |
| 7,234,410 | B2 | 6/2007 | Quigley et al. | |
| 7,243,716 | B2 | 7/2007 | Denniel et al. | |
| 7,285,333 | B2 | 10/2007 | Wideman et al. | |
| 7,306,006 | B1 | 12/2007 | Cornell | |
| 7,328,725 | B2 | 2/2008 | Henry et al. | |
| 7,498,509 | B2 | 3/2009 | Brotzell et al. | |
| 7,523,765 | B2 | 4/2009 | Quigley et al. | |
| 7,600,537 | B2 | 10/2009 | Bhatnagar et al. | |
| 7,647,948 | B2 | 1/2010 | Quigley et al. | |
| 8,187,687 | B2 | 5/2012 | Wideman et al. | |
| 2001/0006712 | A1 | 7/2001 | Hibino et al. | |
| 2001/0013669 | A1 | 8/2001 | Cundiff et al. | |
| 2001/0025664 | A1 | 10/2001 | Quigley et al. | |
| 2002/0040910 | A1 | 4/2002 | Pahl | |
| 2002/0081083 | A1 | 6/2002 | Griffioen et al. | |
| 2002/0094400 | A1 | 7/2002 | Lindstrom et al. | |
| 2002/0119271 | A1 | 8/2002 | Quigley et al. | |
| 2002/0185188 | A1 | 12/2002 | Quigley et al. | |
| 2003/0008577 | A1 | 1/2003 | Quigley et al. | |
| 2003/0087052 | A1 | 5/2003 | Wideman et al. | |
| 2004/0014440 | A1 | 1/2004 | Makela et al. | |
| 2004/0025951 | A1 | 2/2004 | Baron et al. | |
| 2004/0052997 | A1 | 3/2004 | Santo | |
| 2004/0074551 | A1 | 4/2004 | McIntyre | |
| 2004/0094299 | A1 | 5/2004 | Jones | |
| 2004/0096614 | A1 | 5/2004 | Quigley et al. | |
| 2004/0134662 | A1 * | 7/2004 | Chitwood et al. | 166/367 |
| 2004/0226719 | A1 | 11/2004 | Morgan et al. | |
| 2004/0265524 | A1 | 12/2004 | Wideman et al. | |
| 2005/0087336 | A1 * | 4/2005 | Surjaatmadja et al. | 166/105.5 |
| 2005/0189029 | A1 | 9/2005 | Quigley et al. | |
| 2006/0000515 | A1 | 1/2006 | Huffman | |
| 2006/0054235 | A1 | 3/2006 | Cohen et al. | |
| 2006/0249508 | A1 | 11/2006 | Teufl et al. | |
| 2007/0125439 | A1 | 6/2007 | Quigley et al. | |
| 2007/0154269 | A1 | 7/2007 | Quigley et al. | |
| 2007/0187103 | A1 | 8/2007 | Crichlow | |
| 2007/0246459 | A1 | 10/2007 | Loveless et al. | |
| 2008/0006337 | A1 | 1/2008 | Quigley et al. | |
| 2008/0006338 | A1 | 1/2008 | Wideman et al. | |
| 2008/0014812 | A1 | 1/2008 | Quigley et al. | |
| 2008/0164036 | A1 | 7/2008 | Bullen | |
| 2008/0185042 | A1 | 8/2008 | Feechan et al. | |
| 2008/0210329 | A1 | 9/2008 | Quigley et al. | |
| 2009/0090460 | A1 | 4/2009 | Wideman et al. | |
| 2009/0107558 | A1 | 4/2009 | Quigley et al. | |
| 2009/0173406 | A1 | 7/2009 | Quigley et al. | |
| 2009/0194293 | A1 | 8/2009 | Stephenson et al. | |
| 2009/0278348 | A1 | 11/2009 | Brotzell et al. | |
| 2010/0101676 | A1 | 4/2010 | Quigley et al. | |

FOREIGN PATENT DOCUMENTS

| | | | |
|---|---|---|---|
| CH | 461199 | | 8/1968 |
| DE | 1959738 | | 6/1971 |
| DE | 3603597 | | 8/1987 |
| DE | 4040400 | A1 | 8/1992 |
| DE | 4214383 | C1 | 9/1993 |
| DE | 19905448 | A1 | 8/2000 |
| EP | 0024512 | | 3/1981 |
| EP | 0203887 | A2 | 12/1986 |
| EP | 352148 | | 1/1990 |
| EP | 0427306 | A2 | 5/1991 |
| EP | 0477704 | A1 | 4/1992 |
| EP | 0503737 | A1 | 9/1992 |
| EP | 505815 | A2 | 9/1992 |
| EP | 0536844 | A1 | 4/1993 |
| EP | 0681085 | A2 | 11/1995 |
| EP | 0854029 | A2 | 7/1998 |
| EP | 0953724 | A2 | 11/1999 |
| EP | 0970980 | | 1/2000 |
| EP | 0981992 | A1 | 3/2000 |
| FR | 989204 | | 9/1951 |
| GB | 553110 | | 5/1943 |
| GB | 809097 | | 2/1959 |
| GB | 909187 | | 10/1962 |
| GB | 956500 | | 4/1964 |
| GB | 1297250 | | 11/1972 |
| GB | 2103744 | A | 2/1983 |
| GB | 2159901 | A | 12/1985 |
| GB | 2193006 | A | 1/1988 |
| GB | 2255994 | A | 11/1992 |
| GB | 2270099 | A | 3/1994 |
| GB | 2365096 | | 2/2002 |
| JP | 163 592 | | 6/1990 |
| WO | WO-87/04768 | | 8/1987 |
| WO | WO-91/13925 | | 9/1991 |
| WO | WO-92/21908 | | 12/1992 |
| WO | WO-9307073 | A1 | 4/1993 |
| WO | WO-9319927 | | 10/1993 |
| WO | WO-95/02782 | A1 | 1/1995 |
| WO | WO-97/12115 | A2 | 4/1997 |
| WO | WO-97/12166 | A1 | 4/1997 |
| WO | WO-9748932 | A1 | 12/1997 |
| WO | WO-99/19653 | A1 | 4/1999 |
| WO | WO-9961833 | A1 | 12/1999 |
| WO | WO-0009928 | A1 | 2/2000 |
| WO | WO-0031458 | A1 | 6/2000 |
| WO | WO-0073695 | A1 | 12/2000 |
| WO | WO-2006003208 | A1 | 1/2006 |

OTHER PUBLICATIONS

International Search Report mailed on Mar. 5, 2001.

International Search Report mailed on Nov. 8, 2005.

Austigard E. and R. Tomter; "Composites Subsea: Cost Effective Products; an Industry Challenge ", Subsea 94 International Conference, the 1994 Report on Subsea Engineering: The Continuing Challenges.

Connell Mike et al.; "Coiled Tubing: Application for Today's Challenges", Petroleum Engineer International, pp. 18-21 (Jul. 1999).

Feechan Mike et al.; "Spoolable Composites Show Promise", The American Oil & Gas Reporter, pp. 44-50 (Sep. 1999).

Fowler Hampton et al.; "Development Update and Applications of an Advanced Composite Spoolable Tubing", Offshore Technology Conference held in Houston Texas from 4th to 7th of May 1998, pp. 157-162.

Fowler Hampton; "Advanced Composite Tubing Usable", The American Oil & Gas Reporter, pp. 76-81 (Sep. 1997).

Hahn H. Thomas and Williams G. Jerry; "Compression Failure Mechanisms in Unidirectional Composites". NASA Technical Memorandum pp. 1-42 (Aug. 1984).

Hansen et al.; "Qualification and Verification of Spoolable High Pressure Composite Service Lines for the Asgard Field Development Project", paper presented at the 1997 Offshore Technology Conference held in Houston Texas from May 5-8, 1997, pp. 45-54.

Hartman, D.R., et al., "High Strength Glass Fibers," Owens Coming Technical Paper (Jul. 1996).

(56) References Cited

OTHER PUBLICATIONS

Haug et al.; "Dynamic Umbilical with Composite Tube (DUCT)", Paper presented at the 1998 Offshore Technology Conference held in Houston Texas from 4th to 7th, 1998; pp. 699-712.
Lundberg et al.; "Spin-off Technologies from Development of Continuous Composite Tubing Manufacturing Process", Paper presented at the 1998 Offshore Technology Conference held in Houston, Texas from May 4-7, 1998 pp. 149-155.
Marker et al.; "Anaconda: Joint Development Project Leads to Digitally Controlled Composite Coiled Tubing Drilling System", Paper presented at the SPEI/COTA, Coiled Tubing Roundtable held in Houston, Texas from Apr. 5-6, 2000, pp. 1-9.
Measures et al.; "Fiber Optic Sensors for Smart Structures", Optics and Lasers Engineering 16: 127-152 (1992).
Measures R. M.; "Smart Structures with Nerves of Glass". Prog. Aerospace Sci. 26(4): 289-351 (1989).
Moe Wood T. et al.; "Spoolable, Composite Piping for Chemical and Water Injection and Hydraulic Valve Operation", Proceedings of the 11th International Conference on Offshore Mechanics and Arctic Engineering-I992-, vol. III, Part A—Materials Engineering, pp. 199-207 (1992).
Poper Peter; "Braiding", International Encyclopedia of Composites, Published by VGH, Publishers, Inc., 220 East 23rd Street, Suite 909, New York, NY 10010.
Quigley et al.; "Development and Application of a Novel Coiled Tubing String for Concentric Workover Services", Paper presented at the 1997 Offshore Technology Conference held in Houston, Texas from May 5-8, 1997, pp. 189-202.
Rispler K. et al.; "Composite Coiled Tubing in Harsh Completion/Workover Environments", Paper presented at the SPE Gas Technology Symposium and Exhibition held in Calgary, Alberta, Canada, on Mar. 15-18, 1998, pp. 405-410.
Sas-Jaworsky II Alex.; "Developments Position CT for Future Prominence", The American Oil & Gas Reporter, pp. 87-92 (Mar. 1996).
Sas-Jaworsky II and Bell Steve "Innovative Applications Stimulate Coiled Tubing Development", World Oil, 217(6): 61 (Jun. 1996).
Sas-Jaworsky II and Mark Elliot Teel; "Coiled Tubing 1995 Update: Production Applications", World Oil, 216 (6): 97 (Jun. 1995 ).
Sas-Jaworsky, A. and J.G. Williams, "Advanced composites enhance coiled tubing capabilities", World Oil, pp. 57-69 (Apr. 1994).
Sas-Jaworsky, A. and J.G. Williams, "Development of a composite coiled tubing for oilfield services", Society of Petroleum Engineers, SPE 26536, pp. 1-11 (1993).
Sas-Jaworsky, A. and J.G. Williams, "Enabling capabilities and potential applications of composite coiled tubing", Proceedings of World Oil's 2nd International Conference on Coiled Tubing Technology, pp. 2-9 (1994).
Shuart J. M. et al.; "Compression Behavior of ≠45o-Dominated Laminates with a Circular Hole or Impact Damage", AIAA Journal 24(1):115-122 (Jan. 1986).
Silverman A. Seth; "Spoolable Composite Pipe for Offshore Applications", Materials Selection & Design pp. 48-50 (Jan. 1997).
Williams G. J. et al.; "Composite Spoolable Pipe Development, Advancements, and Limitations", Paper presented at the 2000 Offshore Technology Conference held in Houston Texas from May 1-4, 2000, pp. 1-16.
Williams, J.G., "Oil Industry Experiences with Fiberglass Components," Offshore Technology Conference, 1987, pp. 211-220.
Dalmolen "The Properties, Qualification, and System Design of, and Field Experiences with Reinforced Thermoplastic Pipe for Oil and Gas Applications" NACE International, 2003 West Conference (Feb. 2003).
Fiberspar Tech Notes, "Horizontal well deliquification just got easier—with Fiberspar Spoolable Production Systems," TN21-R1UN1-HybridLift, 2010, 2 pages.
International Search Report and Written Opinion for International Patent Application No. PCT/US2010/060582 mailed on Feb. 16, 2011 (10 pages).
Mesch, K.A., "Heat Stabilizers," Kirk-Othmer Encyclopedia of Chemical Technology, 2000 pp. 1-20.
Sperling, L.H., "Introduction to Physical Polymer Science 3rd Edition," Wiley-Interscience, New York, NY, 2001, p. 100.

* cited by examiner

DOWNHOLE FLUID SEPARATION

CROSS-REFERENCE TO RELATED APPLICATIONS

This application claims priority to and the benefit of U.S. provisional patent application Ser. No. 61/146,785, filed Jan. 23, 2009, which is incorporated herein by reference in its entirety.

FIELD

The present invention relates generally to the field of fluid transport, and more particularly to methods and devices for operating, monitoring and controlling pumps at a below ground location in a wellhole, such as an oil or gas producing wellhole.

BACKGROUND

Produced water is underground formation water that is brought to the surface along with oil or gas. It is by far the largest (in volume) by-product or waste stream associated with oil and gas production. According to the American Petroleum Institute (API), about 18 billion barrels (bbl) of produced water were generated by U.S. onshore operations in 1995 (API 2000). Additional large volumes of produced water are generated at U.S. offshore wells and at thousands of wells in other countries, and it has been estimated that in 1999 there was an average of 210 million bbl of water produced each day worldwide. This volume represented about 77 billion bbl of produced water for the entire year. Given that worldwide oil production from conventional sources is nearly 80 million barrels per day (bbl/d, or bpd), one may conclude that 3 bbl of water are produced for each 1 bbl of oil worldwide, and that for the United States, one of the most mature petroleum provinces in the world, the ratio is closer to 6 or 7 bbl of water per 1 bbl of oil. One estimate, in 2004, calculated that more than 14 billion bbl of produced water was derived directly from state oil and gas agencies, with this estimate not including produced water from coal-bed methane (CBM) wells or from offshore U.S. production.

Management of produced water presents challenges and costs to operators. The cost of managing produced water after it is already lifted to the surface and separated from the oil or gas product can range from less than $0.01 to more than several dollars per barrel. If the entire process of lifting, treating, and reinjecting can be avoided, costs are likely to be reduced. With this idea in mind, during the 1990s, oil and gas industry engineers developed various technologies to separate oil or gas from water inside the well. The oil- or gas-rich stream is thereafter carried to the surface, while the water-rich stream is injected to an underground formation without ever being lifted to the surface. These devices are known as downhole oil/water separators (DOWS) and downhole gas/water separators (DGWS).

A number of downhole separation systems have been developed, tested and in some cases implemented, but these have been hampered by several problems implicit in the current systems. These problems include, for example, the fact that downhole equipment is more complicated and expensive that traditional equipment, the installation of the downhole equipment is more complex, and the downhole equipment has to be removed for maintenance at intervals using conventional and expensive equipment.

In addition, a number of authorities require metering of the water injected even if it is not brought to surface, meaning that the downhole equipment is further complicated. The pumps, and possibly meters, have to be powered and the data brought to surface. This requires installing cables into the well further complicating installation and removal, with these power and data cables themselves being sources of failure because they are exposed in installation and easily damaged. Finally, the application of downhole separation is usually most desirable in high water/low producing hydrocarbon wells which cannot stand the additional cost of the current technology.

SUMMARY

The present invention includes methods and systems for operating, monitoring, and controlling fluid control systems at a below ground, or downhole, location in a wellhole.

In one aspect, the invention includes a system for operating, monitoring and controlling pumps at a below ground location in a wellhole. The system includes a downhole fluid control system comprising at least one pump, a spoolable composite pipe comprising a fluid channel and at least one energy conductor, and a distal connection device. The distal connection device is adapted to couple a distal end of the fluid channel to the at least one pump and couple a distal end of the at least one energy conductor to the downhole fluid control system.

In one embodiment, the energy conductor includes at least one of a power conductor and a data conductor. The power conductor may include at least one of an electrical power conductor and a hydraulic power conductor. The data conductor may include at least one of a fiber-optic cable and an electrically conductive cable. In one embodiment, the electrically conductive cable includes copper.

The spoolable composite pipe may include a plurality of layers, including, for example, a substantially fluid impervious inner layer, a composite layer enclosing the inner layer and comprising high strength fibers, and an outer protective layer enclosing the composite layer and inner liner. The substantially fluid impervious inner layer may define the fluid channel. In one embodiment, the at least one energy conductor is embedded within at least one layer of the spoolable composite pipe. The at least one energy conductor may be helically wound around at least one inner layer of the spoolable composite pipe, or may extend substantially parallel with an elongate axis of the spoolable composite pipe.

In one embodiment, the spoolable composite pipe includes at least one reinforcing element. The pipe may be designed so that the total elongation of the pipe under maximum load conditions is always less than the elongation to failure of any integrated conductor. The spoolable composite pipe may include a bonding element. In one embodiment, the bonding element is adapted to provide load transfer between the at least one energy conductor and at least one layer of the spoolable composite pipe.

In one embodiment, the downhole fluid control system includes a measurement device. The measurement device may include at least one of a flow meter, a pressure meter, a temperature meter, a stress meter, a strain gauge, and a chemical composition measuring device.

In one embodiment, the system further includes a proximal connection device adapted to connect a proximal end of the spoolable composite pipe to external pipework above a wellhead. The proximal connection device may be adapted to be seated within the wellhead. The system may further include a sealed wireway adapted to allow breakout of a proximal end of the at least one energy conductor from a wellhead.

In one embodiment, the system may include at least one power element coupled to the proximal end of the energy conductor. In one embodiment, the system may include at least one of a communication device and a control device coupled to the proximal end of the energy conductor. In one embodiment, the system may include a spooling system adapted to at least one of deploy and remove the spoolable composite pipe. In one embodiment, the distal connection device is adapted to at least one of provide fluid pressure integrity and transfer tensile loads.

The downhole fluid control system may further include at least one fluid separation device. The fluid separation device may be adapted to separate a fluid mixture passing through the downhole fluid control system into at least one first fluid and at least one second fluid. The at least one first fluid may be directed into the fluid channel of the spoolable composite pipe. The at least one second fluid may be directed into an underground formation.

Another aspect of the invention includes a method of providing a fluid separation system at a below ground location in a wellhole. The method includes providing a spoolable composite pipe comprising a fluid channel and at least one energy conductor, providing a downhole fluid control system comprising at least one pump, coupling a distal end of the fluid channel to at least one of the pump and the water separation device, coupling a distal end of the at least one energy conductor to the downhole fluid control system, and unspooling the spoolable composite pipe from a reel to deploy the downhole fluid control system down a wellhole.

In one embodiment, the method further includes connecting a proximal end of the spoolable composite pipe to external pipework above a wellhead. In one embodiment, the method further includes coupling at least one power element to the proximal end of the energy conductor. In one embodiment, the method further includes coupling at least one of a communication device and a control device to the proximal end of the energy conductor. In one embodiment, the downhole fluid control system includes at least one fluid separation device, wherein the fluid separation device is adapted to separate a fluid mixture passing through the downhole fluid control system into at least one first fluid and at least one second fluid.

Another aspect of the invention includes a method of separating fluids at a below ground location in a wellhole. The method includes positioning a fluid control system comprising at least one pump and at least one fluid separation device at a below ground location in a wellhole, connecting the fluid control system to an above-ground location through a spoolable composite pipe comprising a fluid channel and at least one energy conductor, providing at least one of a power supply or a control signal to the fluid control system through the at least one energy conductor, passing a fluid mixture through the fluid control system, separating the fluid mixture into at least one first fluid and at least one second fluid, pumping the first fluid to the surface through the fluid channel, and releasing the second fluid to an underground formation.

The first fluid may include at least one of oil-rich fluid and a gas-rich fluid. The second fluid may include a water-rich fluid. The fluid control system may be connected to the spoolable composite pipe prior to positioning the fluid control system at the below ground location in the wellhole. In one embodiment, the energy conductor comprises at least one of a power conductor and a data conductor. The power supply provided to the fluid control system may include at least one of an electrical power conductor and a hydraulic power conductor.

In one embodiment, the data conductor includes at least one of a fiber-optic cable and an electrically conductive cable. The electrically conductive cable may include copper. In one embodiment, both power supply and control signals are provided to the fluid control system through separate energy conductors. The method may further include connecting a proximal end of the spoolable composite pipe to external pipework above a wellhead.

In one embodiment, the spoolable composite pipe includes a plurality of layers including, for example, a substantially fluid impervious inner layer, a composite layer enclosing the inner layer and comprising high strength fibers, and an outer protective layer enclosing the composite layer and inner liner. The substantially fluid impervious inner layer may define the fluid channel.

In one embodiment, the at least one energy conductor is embedded within at least one layer of the spoolable composite pipe. The at least one energy conductor may be helically wound around the at least one inner layer of the spoolable composite pipe, or extend substantially parallel with an elongate axis of the spoolable composite pipe.

In one embodiment, the method further includes measuring at least one property of the fluid mixture passing through the fluid control system. The measuring step may include measuring at least one property of the fluid with at least one of a flow meter, a pressure meter, a temperature meter, a stress meter, a strain gauge, and a chemical composition measuring device.

These and other objects, along with advantages and features of the present invention, will become apparent through reference to the following description, the accompanying drawings, and the claims. Furthermore, it is to be understood that the features of the various embodiments described herein are not mutually exclusive and may exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION OF THE INVENTION

To provide an overall understanding, certain illustrative embodiments will now be described; however, it will be understood by one of ordinary skill in the art that the systems and methods described herein can be adapted and modified to provide systems and methods for other suitable applications and that other additions and modifications can be made without departing from the scope of the systems and methods described herein.

Unless otherwise specified, the illustrated embodiments can be understood as providing exemplary features of varying detail of certain embodiments, and therefore, unless otherwise specified, features, components, modules, and/or aspects of the illustrations can be otherwise combined, separated, interchanged, and/or rearranged without departing from the disclosed systems or methods. Additionally, the shapes and sizes of components are also exemplary and unless otherwise specified, can be altered without affecting the scope of the disclosed and exemplary systems or methods of the present disclosure.

One embodiment of the invention includes a spoolable pipe that provides a path for conducting fluids (i.e., liquids and gases) along the length of the spoolable pipe. For example, the spoolable pipe can transmit fluids down a well hole for operations upon the interior surfaces of the well hole, the spoolable pipe can transmit fluids or gases to hydraulic or pneumatic machines operably coupled to the spoolable pipe, and/or the spoolable pipe can be used to transmit fluids on surface from well holes to transmission or distribution pipelines. Accordingly, the spoolable pipe can provide a conduit for powering and controlling hydraulic and/or pneumatic machines, and/or act as a conduit for fluids, for example gases or liquids.

Figure 1:
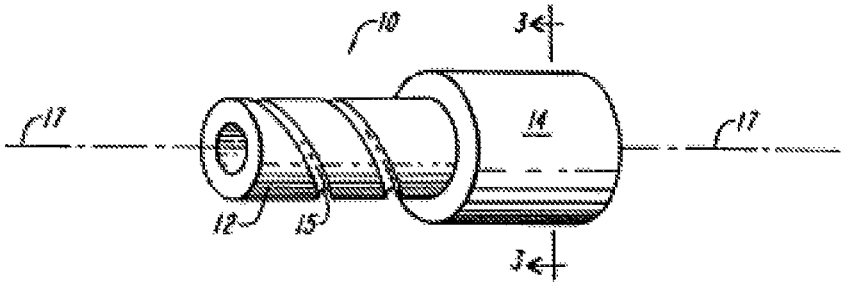
FIG. 1 is a side view, partially broken away, of a spoolable pipe that includes an inner pressure barrier and a reinforcing layer, in accordance with one embodiment of the invention.

FIG. 1 illustrates a spoolable pipe 10 constructed of an internal pressure barrier 12 and a reinforcing layer 14. The spoolable pipe can be generally formed along a longitudinal axis 17. Although illustrated in FIG. 1 as having a circular cross-section, the disclosed spoolable pipe can have a variety of tubular cross-sectional shapes, including but not limited to circular, oval, rectangular, square, polygonal, and/or others.

The internal pressure barrier 12, otherwise referred to as a liner, can serve as a pressure containment member to resist leakage of internal fluids from within the spoolable pipe 10. In some embodiments, the internal pressure barrier 12 can include a polymer, a thermoset plastic, a thermoplastic, an elastomer, a rubber, a co-polymer, and/or a composite. The composite can include a filled polymer and a nano-composite, a polymer/metallic composite, and/or a metal (e.g., steel, copper, and/or stainless steel). Accordingly, an internal pressure barrier 12 can include one or more of a high density polyethylene (HDPE), a cross-linked polyethylene (PEX), a polyvinylidene fluoride (PVDF), a polyamide, polyethylene terphthalate, polyphenylene sulfide and/or a polypropylene. In one embodiment, the internal pressure barrier 12 includes a modulus of elasticity greater than about approximately 50,000 psi, and/or a strength greater than about approximately 1,000 psi. In some embodiments, the internal pressure barrier 12 can carry at least fifteen percent of the axial load along the longitudinal axis, at least twenty-five percent of the axial load along the longitudinal axis, or at least thirty percent of the axial load along the longitudinal axis at a termination, while in some embodiments, the internal pressure barrier 12 can carry at least fifty percent of the axial load along the longitudinal axis at a termination. Axial load may be determined at the ends of a pipe. For example, at the ends, or a termination, of a pipe, there may be a tensile (e.g. axial) load equal to the internal pressure multiplied by the area of the pipe.

Referring back to FIG. 1, the spoolable pipe 10 can also include one or more reinforcing layers, such as, for example, one or more composite reinforcing layer 14. In one embodiment, the reinforcing layers can include fibers having a cross-wound and/or at least a partially helical orientation relative to the longitudinal axis of the spoolable pipe. The fibers may have a helical orientation between substantially about thirty degrees and substantially about seventy degrees relative to the longitudinal axis 17. For example, the fibers may be counter-wound with a helical orientation of about ±40°, ±45°, ±50°, ±55°, and/or ±60°. The reinforcing layer may include fibers having multiple, different orientations about the longitudinal axis. Accordingly, the fibers may increase the load carrying strength of the composite reinforcing layer(s) 14 and thus the overall load carrying strength of the spoolable pipe 10. In another embodiment, the reinforcing layer may carry substantially no axial load carrying strength along the longitudinal axis at a termination.

Exemplary fibers include but are not limited to graphite, KEVLAR, fiberglass, boron, polyester fibers, polymer fibers, mineral based fibers such as basalt fibers, and aramid. For example, fibers can include glass fibers that comprise e-cr glass, Advantex®, s-glass, d-glass, or a corrosion resistant glass.

The reinforcing layer(s) 14 can be formed of a number of plies of fibers, each ply including fibers. In one embodiment, the reinforcing layer(s) 14 can include two plies, which can optionally be counterwound unidirectional plies. The reinforcing layer(s) can include two plies, which can optionally be wound in about equal but opposite helical directions. The reinforcing layer(s) 14 can include four, eight, or more plies of fibers, each ply independently wound in a helical orientation relative to the longitudinal axis. Plies may have a different helical orientation with respect to another ply, or may have the same helical orientation. The reinforcing layer(s) 14 may include plies and/or fibers that have a partially and/or a substantially axial orientation. The reinforcing layer may include plies of fibers with an abrasion resistant material disposed between each ply, or optionally disposed between only certain plies. In some embodiments, an abrasion resistant layer is disposed between plies that have a different helical orientation.

The fibers can include structural fibers and flexible yarn components. The structural fibers can be formed of carbon, aramid, thermoplastic, and/or glass. The flexible yarn components, or braiding fibers, can be formed of either polyamide, polyester, aramid, thermoplastic, glass and/or ceramic. The fibers included in the reinforcing layer(s) 14 can be woven, braided, knitted, stitched, circumferentially (axially) wound, helically wound, and/or other textile form to provide an orientation as provided herein (e.g., in the exemplary embodiment, with an orientation between substantially about thirty degrees and substantially about seventy degrees relative to the longitudinal axis 17). The fibers can be biaxially or triaxially braided.

In one embodiment, the reinforcing layer(s) 14 includes fibers having a modulus of elasticity of greater than about 5,000,000 psi, and/or a strength greater than about 100,000 psi. In some embodiments, an adhesive can be used to bond the reinforcing layer(s) 14 to internal pressure barrier 12. In other embodiments, one or more reinforcing layers are substantially not bonded to one or more of other layers, such as the inner liner, internal pressure barriers, or external outer protective layer(s).

Figure 2:
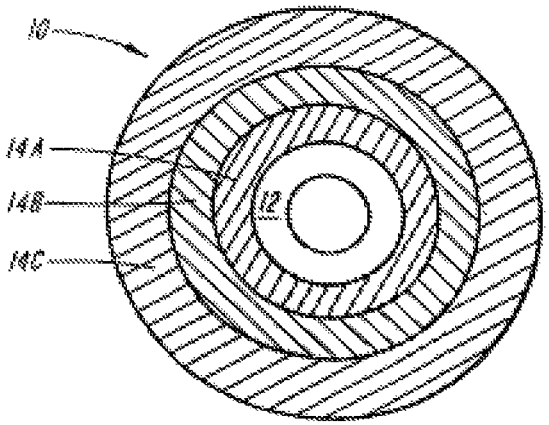
FIG. 2 is a cross-sectional view of a spoolable pipe having an inner pressure barrier surrounded by multiple reinforcing layers, in accordance with one embodiment of the invention.

FIG. 2 illustrates a cross-section of a circular spoolable pipe 10 having an inner pressure barrier liner 12 and a first reinforcing layer 14A, a second reinforcing layer 14B, and a third reinforcing layer 14C. Each of the reinforcing layers 14A-C may be formed of fibers, and each of the reinforcing layers 14A-C successively encompasses and surrounds the underlying reinforcing layer and/or pressure barrier 12.

The fibers in each of the reinforcing layers 14A-C can be selected from the same or different material. For example, the first reinforcing layer 14A can comprise helically oriented glass fibers; second reinforcing layer 14B can comprise a ply having helically oriented glass fiber at the same angle, but at an opposite orientation of the first reinforcing layer 14A; and third reinforcing layer 14C can comprise plies of fibers having a clockwise and counter-clockwise helically oriented glass fibers. Further, the different reinforcing layers 14A-C can include different angles of helical orientation. For example, in one embodiment, the different layers can have angles of orientation between substantially about thirty degrees and substantially about seventy degrees, relative to the axis 17. Alternatively, the different layers can have angles of orientation between substantially about forty-six degrees and substantially about fifty-two degrees, relative to the axis 17. In some embodiments, the different layers 14A-C can have more than one fiber within a layer, such as carbon and glass, and/or carbon and aramid, and/or glass and aramid. Further, the different layers 14A-C may each comprise multiple plies, each independent ply having a different, or substantially the same, helical orientation with respect to other plies within a layer.

Figure 3:
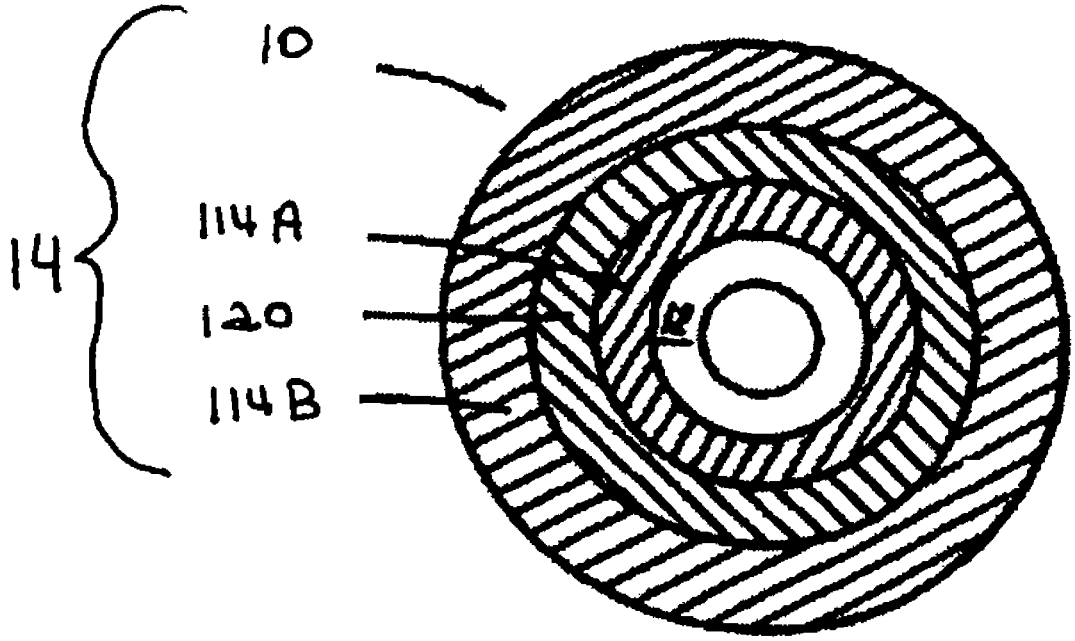
FIG. 3 is cross-sectional view of a spoolable pipe having an inner pressure barrier surrounded by a reinforcing layer that includes two plies of fibers with an abrasion layer between the two plies, in accordance with one embodiment of the invention.

FIG. 3 illustrates a cross-section of a circular spoolable pipe 10 having an inner pressure barrier liner 12 and a first reinforcing layer 14. Reinforcing layer 14 comprises a first ply of fibers 114A, an abrasion resistant layer 120, and a second ply of fibers 114B. Each of the plies 114A, B may be formed of fibers, and each of ply 114A, abrasion resistant layer 120, and ply 114B successively encompasses and surrounds any other underlying reinforcing layer, abrasion resistant layer, ply(s) and/or pressure barrier 12.

The fibers in each of plies 114A, B can be selected from the same or different material. For example, the ply 114A can comprise at least partially helically oriented glass fibers; second ply 114B can comprise a ply having at least partially helically oriented glass fiber at the same angle, but at an opposite orientation of the first ply 114A. Further, the plies 114A, B can include different angles of helical orientation. For example, in one embodiment, the different plies can have angles of orientation between substantially about thirty degrees and substantially about seventy degrees, relative to the axis 17. Alternatively, the different plies can have angles of orientation between substantially about forty-six degrees and substantially about fifty-two degrees, relative to the axis 17. For example, one ply 114A may comprise fibers with helical orientation of about ±40°, ±45°, ±50°, ±55°, and/or ±60°, and a second ply 114B may comprise fibers with about an equal but opposite orientation. One or more plies, or one or more fibers within a ply may be substantially axially oriented. Further, the plies 114A, B can include about the same angle of helical orientation. In some embodiments, the different plies 114A, B can have more than one fiber within a ply, such as carbon and glass, and/or carbon and aramid, and/or glass and aramid.

In some embodiments, the abrasion resistant layer 120 may include a polymer. Such abrasion resistant layers can include a tape or coating or other abrasion resistant material, such as a polymer. Polymers may include polyethylene such as, for example, high-density polyethylene and cross-linked polyethylene, polyvinylidene fluoride, polyamide, polypropylene, terphthalates such as polyethylene therphthalate, and polyphenylene sulfide. For example, the abrasion resistant layer may include a polymeric tape that includes one or more polymers such as a polyester, a polyethylene, cross-linked polyethylene, polypropylene, polyethylene terphthalate, high-density polypropylene, polyamide, polyvinylidene fluoride, polyamide, and a elastomer. An exemplary pipe as in FIG. 3 may include at least one reinforcing layer that includes a first ply of fiber, for example glass, an abrasion resistant layer, for example a polymeric tape spirally wound around the first ply of fiber, and a second ply of fiber with a substantially different, or substantially similar, helical orientation to that of the first ply. In an alternative embodiment, the reinforcing layer 14 may include four, eight, or more plies of fibers, with an abrasion resistant layer optionally between each ply.

Figure 4:
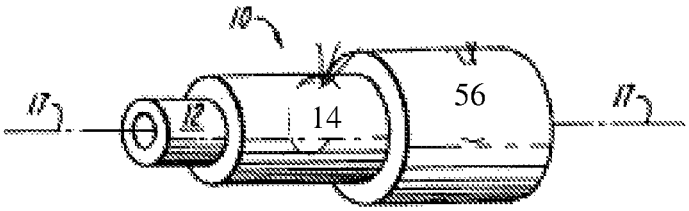
FIG. 4 is a side view, partially broken away, of a spoolable pipe having an inner pressure barrier, a reinforcing layer, and an external layer, in accordance with one embodiment of the invention.

FIG. 4 illustrates a spoolable pipe 10 elongated along an axis 17 and having an internal pressure barrier 12, a reinforcing layer 14, and at least one external/outer protective layer 56 enclosing the reinforcing layer(s) 14. The external layer(s) 56 may otherwise be understood to be an outer protective layer. The external layer 56 can bond to a reinforcing layer(s) 14, and in some embodiments, also bond to an internal pressure barrier 12. In other embodiments, the external layer 56 is substantially unbonded to one or more of the reinforcing layer(s) 14, or substantially unbonded to one or more plies of the reinforcing layer(s) 14. The external layer 56 may be partially bonded to one or more other layers of the pipe.

The external layer(s) 56 can provide wear resistance and impact resistance. For example, the external layer 56 can provide abrasion resistance and wear resistance by forming an outer surface to the spoolable pipe that has a low coefficient of friction thereby reducing the wear on the reinforcing layers from external abrasion. Further, the external layer 56 can provide a seamless layer, to, for example, hold the inner layers 12, 14 of the coiled spoolable pipe 10 together. The external layer 56 can be formed of a filled or unfilled polymeric layer. Alternatively, the external layer 56 can be formed of a fiber, such as aramid or glass, with or without a matrix. Accordingly, the external layer 56 can be a polymer, thermoset plastic, a thermoplastic, an elastomer, a rubber, a copolymer, and/or a composite, where the composite includes a filled polymer and a nano-composite, a polymer/metallic composite, and/or a metal. In some embodiments, the external layer(s) 56 can include one or more of high density polyethylene (HDPE), a cross-linked polyethylene (PEX), a polyvinylidene fluoride (PVDF), a polyamide, polyethylene terphthalate, polyphenylene sulfide and/or a polypropylene. The external layer 56 can include a modulus of elasticity greater than about approximately 50,000 psi, and/or a strength greater than about approximately 1,000 psi. In an embodiment, the external layer 56 can carry at least ten percent, twenty percent, twenty-five percent, thirty percent or even at least fifty percent of an axial load in the longitudinal direction at a termination. A seamless external layer can comprise, for example, a perforated thermoplastic.

In some embodiments, the external layer 56 can be formed by extruding, while the layer 56 can be formed using one or more materials applied at least partially helically and/or at least partially axially along the longitudinal axis 17. The material can include, for example, one or more polymeric tapes. In an example embodiment, the external layer 56 can include and/or otherwise have a coefficient of friction less than a coefficient of friction of a reinforcing layer 14.

Particles can be added to the external layer 56 to increase the wear resistance of the external layer 56. The particles used can include one or more of ceramics, metallics, polymerics, silicas, or fluorinated polymers. For example, adding TEFLON (MP 1300) particles and an aramid powder (PD-T polymer) to the external layer 56 can reduce friction and enhance wear resistance.

It can be understood that pressure from fluids transported by the spoolable pipes 10 disclosed herein may not be properly released from the reinforcing layer(s) 14, and/or from the inner pressure barrier liner and/or from within the external layer, without, for example, an external layer having a permeability to provide such pressure release. Such accumulation of pressure can cause deterioration of the spoolable pipe 10, for example, external layer rupture or inner pressure barrier collapse. Accordingly, in some embodiments, to allow for pressure release along the length of the spoolable pipe 10, the external layer(s) 56 can include and/or have a permeability at least five, or at least ten times greater than the permeability of the internal pressure barrier 12. For example, external layer(s) 56 include perforations or holes spaced along the length of pipe. Such perforations can, for example, be spaced apart about every 10 ft, about every 20 ft, about every 30 ft, and even about or greater than about every 40 ft. In one embodiment, the external layer 56 can be perforated to achieve a desired permeability, while additionally and optionally, an external layer 56 can include one or more polymeric tapes, and/or may be discontinuous.

One example spoolable pipe 10 can also include one or more couplings or fittings. For example, such couplings may engage with, be attached to, or in contact with one or more of the internal and external layers of a pipe, and may act as a mechanical load transfer device. Couplings may engage one or both of the inner liner, the external wear layer or the reinforcing layer. Couplings or fittings may be comprised, for example, of metal or a polymer, or both. In some embodiments, such couplings may allow pipes to be coupled with other metal components. In addition, or alternatively, such couplings or fittings may provide a pressure seal or venting mechanism within or external to the pipe. One or more couplings may each independently be in fluid communication with the inner layer and/or in fluid communication with one or more reinforcing layers and/or plies of fibers or abrasion resistant layers, and/or in fluid communication with an external layer. Such couplings may provide venting, to the atmosphere, of any gasses or fluids that may be present in any of the layers between the external layer and the inner layer, inclusive.

Figure 5:
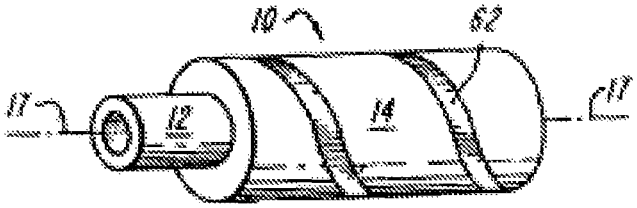
FIG. 5 is a side view, partially broken away, of a spoolable pipe that includes an energy conductor.

With reference to FIG. 5, a spoolable pipe 10 can also include one or more energy conductors 62 that can be integral with the wall of the spoolable pipe 10. The energy conductors 62 can be integral with the internal pressure barrier, reinforcing layer(s), outer protective layers, and/or barrier layers and/or exist between such internal pressure barrier 12 and reinforcing layer 14, and/or exist between the internal pressure barrier 12 and an external outer protective layer. In some embodiments, the energy conductor 62 can extend along the length of the spoolable pipe 10. The energy conductors 62 can include an electrical guiding medium (e.g., electrical wiring), an optical and/or light guiding medium (e.g., fiber optic cable), a hydraulic power medium (e.g., a high pressure pipe or a hydraulic hose), a data conductor, and/or a pneumatic medium (e.g., high pressure tubing or hose).

The disclosed energy conductors 62 can be oriented in at least a partially helical direction relative to a longitudinal 17 axis of the spoolable pipe 10, and/or in an axial direction relative to the longitudinal axis 17 of the spoolable pipe 10.

FIG. 5 illustrates a spoolable pipe 10 elongated along an axis 17 wherein the spoolable pipe includes an internal pressure barrier 12, a reinforcing layer 14, and an energy conductor 62. In the FIG. 5 embodiment, the energy conductor 62 forms part of the reinforcing layer 14; however, as provided previously herein, it can be understood that the energy conductor(s) 62 can be integrated with and/or located between internal pressure barrier 12 and the reinforcing layer 14.

A hydraulic control line embodiment of the energy conductor 62 can be either formed of a metal, composite, and/or a polymeric material.

In one embodiment, several energy conductors 62 can power and/or control a machine operably coupled to the coiled spoolable pipe 10. For instance, a spoolable pipe 10 can include three electrical energy conductors that provide a primary line 62, a secondary line 62, and a tertiary line 62 for electrically powering a machine using a three-phase power system. As provided previously herein, the spoolable pipe 10 can also include internal pressure barriers 12 for transmitting fluids along the length of the pipe 10. Possible machines include, but are not limited to, pumps, fluid separation systems, measurement devices, flow control devices, and/or drilling devices.

In one embodiment of the invention, an energy conductor may be coupled to one or more sensors mounted with the pipe, attached to the pipe, or located at an end of the pipe. In one embodiment, the sensor is a structure that senses either the absolute value or a change in value of a physical quantity. Exemplary sensors for identifying physical characteristics include acoustic sensors, optical sensors, mechanical sensors, electrical sensors, fluidic sensors, pressure sensors, temperature sensors, strain sensors, and chemical sensors.

Optical sensors include intensity sensors that measure changes in the intensity of one or more light beams and interferometric sensors that measure phase changes in light beams caused by interference between beams of light. Optical intensity sensors can rely on light scattering, spectral transmission changes, microbending or radiative losses, reflectance changes, and changes in the modal properties of optical fiber to detect measurable changes. One embodiment of the invention may include an optical chemical sensor to perform remote spectroscopy (either absorption or fluorescence) of a substance.

Optical temperature sensors include those sensors that: remotely monitor blackbody radiation; identify optical path-length changes, via an interferometer, in a material having a known thermal expansion coefficient and refractive index as a function of temperature; monitor absorption characteristics to determine temperature; and monitor fluorescence emission decay times from doped compositions to determine temperature. For instance, optical fibers having a Bragg Grating etched therein can be used to sense temperature with an interferometer technique.

In one embodiment, Bragg Gratings can also be used to measure strain. Particularly, a refractive index grating can be created on a single-mode optical fiber and the reflected and transmitted wavelength of light from the grating can be monitored. The reflected wavelength of light varies as a function of strain induced elongation of the Bragg Grating. Other optical sensors measure strain by stimulated Brillouin scattering and through polarimetry in birefringent materials.

Hybrid sensors including optical fibers can also be fashioned to detect electrical and magnetic fields. Typically, the optical fiber monitors changes in some other material, such as a piezo crystal, that changes as a function of electrical or magnetic fields. For example, the optical fiber can determine dimensional changes of a piezoelectric or piezomagnetic material subjected to electric or magnetic fields, respectively. Bragg Gratings in an optical fiber can also be used to measure high magnetic fields. In particular, the Naval Research Laboratory has identified that the reflectance of a Bragg Grating as a function of wavelength differed for right and left circularly polarized light. The Naval Research Laboratory observed that magnetic fields can be detected by interferometrically reading the phase difference due to the Bragg Grating wavelength shifts.

Fiber optic sensors for measuring current also exist. Hoya Glass and Tokyo Electric Power Co. identified that a single-mode optical fiber made of flint glass (high in lead) can be used to sense current. Current is measured by observing the rotation of polarized light in the optical fiber.

In one embodiment, optical pressure sensors that rely on movable diaphragms, Fabry-Perot interferometers, or microbending, may be utilized. The movable diaphragm typically senses changes in pressure applied across the diaphragm using piezoresistors mounted on the diaphragm. The resistance of the piezoresistors varies as the diaphragm flexes in response to various pressure levels. The Fabry-Perot interferometers can include one two parallel reflecting surfaces wherein one of the surfaces moves in response to pressure changes. The interferometers then detect the movement of the surface by comparing the interference patterns formed by light reflecting of the moving surface. Microbending sensors can be formed of two opposing serrated plates that bend the fiber in response to the pressure level. The signal loss in the fiber resulting from the movement of the opposing serrated plates can be measured, thereby sensing displacement and pressure change.

Various optical sensors exist for measuring displacement and position. Simple optical sensors measure the change in retroreflectance of light passing through an optical fiber. The change in retroflectance occurs as a result of movement of a proximal mirror surface.

Additionally, optical sensors can be employed to measure acoustics and vibration. For example, an optical fiber can be wrapped around a compliant cylinder. Changes in acoustic waves or vibrations flex the cylinder and in turn stress the coil of optical fiber. The stress on the optical fiber can be measured interferometrically and is representative of the acoustic waves or vibrations impacting the cylinder.

Mechanical sensors suitable for deployment in the composite tubular member 10 include piezoelectric sensors, vibration sensors, position sensors, velocity sensors, strain gauges, and acceleration sensors. The sensor can also be selected from those electrical sensors, such as current sensors, voltage sensors, resistivity sensors, electric field sensors, and magnetic field sensors. Fluidic sensors appropriate for selection as the sensor include flow rate sensors, fluidic intensity sensors, and fluidic density sensors. Additionally, the sensor can be selected to be a pressure sensor, such as an absolute pressure sensor or a differential pressure sensor. For example, the sensor can be a semiconductor pressure sensor having a moveable diaphragm with piezoresistors mounted thereon.

The sensor can be also selected to be a temperature sensor. Temperature sensors include thermocouples, resistance thermometers, and optical pyrometers. A thermocouple makes use of the fact that junctions between dissimilar metals or alloys in an electrical circuit give rise to a voltage if they are at different temperatures. The resistance thermometer consists of a coil of fine wire. Copper wires lead from the fine wire to a resistance measuring device. As the temperature varies the resistance in the coil of fine wire changes.

One embodiment of the invention may utilize a spoolable composite pipe including one or more energy conductors, as described herein, to connect to and at least one of power, operate, monitor, and control a downhole fluid control system at a below ground location in a wellhole. These downhole fluid control systems may, for example, include one or more pumps and/or one or more fluid separation devices for using in downhole well systems. The fluid separation devices may, for example, include downhole oil/water separators (DOWS) and/or downhole gas/water separators (DGWS).

In one example embodiment, a spoolable composite pipe including one or more energy conductors may be connected to a DOWS system. DOWS technology reduces the quantity of produced water that is handled at the surface by separating it from the oil downhole and simultaneously injecting it underground. A DOWS system may include, for example, an oil/water separation system and at least one pump to lift oil to the surface and inject the water. Two basic types of DOWS systems have been developed, one that uses hydrocyclones to mechanically separate oil and water, and the other relies on gravity separation that takes place in the well bore.

Hydrocyclones use centrifugal force to separate fluids of different specific gravity. They operate without any moving parts. A mixture of oil and water enters the hydrocyclone at a high velocity from the side of a conical chamber. The subsequent swirling action causes the heavier water to move to the outside of the chamber and exit through one end, while the lighter oil remains in the interior of the chamber and exits through a second opening. The water fraction, containing a low concentration of oil (typically less than 500 mg/L), can then be injected, and the oil fraction along with some water is pumped to the surface. The Hydrocyclone-type DOWS may be coupled with pumps, such as electric submersible pumps (ESPs), progressing cavity pumps, gas lift pumps, and rod pumps.

Gravity separator-type DOWS are designed to allow the oil droplets that enter a well bore through perforations to rise and form a discrete oil layer in the well. Most gravity separator tools are vertically oriented and have two intakes, one in the oil layer and the other in the water layer. This type of DOWS may use rod pumps, although other types of pump, including, but not limited to as electric submersible pumps (ESPs), progressing cavity pumps, gas lift pumps, may also be used. As the sucker rods move up and down, the oil is lifted to the surface and the water is injected. In an alternative embodiment, a gravity-separation DOWS that works by allowing gravity separation to occur in the horizontal section of an extended reach well may also be used. The downhole conditions allow for rapid separation of oil and water. Oil is lifted to the surface, while water is injected by a hydraulic submersible pump.

In another example embodiment, a spoolable composite pipe including one or more energy conductors may be connected to a DGWS system. Since the difference in specific gravity between natural gas and water is large, allowing separation to occur more easily in the well, the purpose of the DGWS is not so much one of separation of the fluid streams but of disposing the water downhole while allowing gas production. This technology is somewhat different than DOWS technology, for which the fluid separation component is very important.

DGWS technologies can be classified into four main categories: bypass tools, modified plunger rod pumps, ESPs, and progressive cavity pumps. The particular DGWS system most appropriate for a particular application may depend on factors including, but not limited to, the depth involved, the specific application, produced water rates, and well depth.

Bypass tools are installed at the bottom of a rod pump. On the upward pump stroke, water is drawn from the casing-piping annulus into the pump chamber through a set of valves. On the next downward stroke, these valves close and another set of valves opens, allowing the water to flow into the piping. Water accumulates in the piping until it reaches a sufficient hydrostatic head so that it can flow by gravity to a disposal formation. The pump provides no pressure for water injection; water flows solely by gravity. Bypass tools may be appropriate, for example, for water volumes from 25 to 250 bbl/d and for depths up to approximately 8,000 ft.

Modified plunger rod pump systems incorporate a rod pump, which has its plunger modified to act as a solid assembly, and an extra section of pipe with several sets of valves located below the pump. On the upward pump stroke, the plunger creates a vacuum and draws water into the pump barrel. On the downward stroke, the plunger forces water out of the pump barrel to a disposal zone. This type of DGWS can generate higher pressure than the bypass tool, which is useful for injecting into a wide range of injection zones. Modified plunger rod pump systems may, in one embodiment, be well suited for moderate to high water volumes (250 to 800 bbl/d) and depths from 2,000 to 8,000 ft.

ESPs may, in one embodiment, be used in the petroleum industry to lift fluids to the surface. In a DGWS application, they can be configured to discharge downward to a lower injection zone. A packer is used to isolate the producing and injection zones. ESPs can, in one embodiment, handle flow rates greater than 800 bbl/d, and can operate at great depths (more than 6,000 ft).

The fourth type of DGWS uses progressive cavity pumps (also referred to as progressing cavity pumps). This type of pump has been used throughout the petroleum industry. For DGWS applications, the pump is configured to discharge downward to an injection zone, or the pump rotor can be designed to turn in a reversed direction. In an alternate configuration, the progressive cavity pump can be used with a bypass tool. Then the pump would push water into the piping, and the water would flow by gravity to the injection formation. Progressive cavity pumps can, in one embodiment, handle solids (e.g., sand grains or scale) more readily than rod pumps or ESPs.

One embodiment of the invention provides an integrated and spoolable pipe incorporating at least one of a fluid channel and one or more energy conductors (such as, but not limited to, one or more power conductors and/or one or more data conductors) for incorporation into a downhole fluid control system. The spoolable pipe may include any of the elements described hereinabove, and may be used with any of the DOWS and/or DGWS described herein, or for any other appropriate downhole fluid control system including elements such as, but not limited to, pumps, measurement devices, fluid separation devices, fluid control devices, and/or drilling devices.

Using such spoolable composite pipes including both a fluid channel and at least one integrated energy conductor provides significant advantages over prior downhole fluid control systems. These advantages may include, but are not limited to, easier installation, easier operation, easier removal, and/or improved reliability of downhole separation systems, and/or significantly reduced costs related with the installation, use, maintenance, and removal of such systems. These lower costs not only increase the viability of downhole separation in existing wells, but also promote viability of wells which cannot be cost-effectively drilled or completed by any other method. More particularly, a downhole fluid control system coupled to a spoolable pipe with integrated energy conductor(s) may enable the commercial viability of downhole separation in even marginal wells by providing, for example, a simpler and lower cost installation and removal system, protection of the energy conductor(s) during installation and removal for better reliability, simple downhole metering with incorporated power and data channels to the surface to meet regulatory requirements, and/or improved control of downhole equipment for better reliability and longer well life.

One example embodiment of the invention may include, for example, a system for operating and controlling a downhole fluid control system including one or more downhole pumps, one or more metering devices, one or more fluid separation devices, a spoolable composite pipe fluid channel and integrated energy conductor(s). The system may further include a connection device on the bottom of the pipe to couple the fluid channel to the downhole device(s) and/or to couple the energy conductor(s) from the pipe to the downhole devices. The system may further include a connection device placed on the top of the pipe to connect the pipe to the external pipework above the well head and to seat in the wellhead, and/or to connect the energy conductor(s) to a sealed wireway to allow breakout of the energy conductor(s) from the wellhead. One embodiment of the invention may further include equipment to control spooling of the system into and/or out of the well when required.

In one embodiment, the integrated energy conductor(s) may include any combination of power conductors, data conductors (such as, but not limited to, electrical conductors and/or fiber optics). These integrated energy conductor(s) can be positioned along an elongate axis of the pipe or helically wound around a pipe as described above.

In one embodiment, the invention provides a composite spoolable pipe, such as any one of the spoolable pipes described herein, which incorporates copper conductors and/or fiber optics which are used to transmit electrical power and data signals. This integrated spoolable pipe is connected directly to downhole fluid control system elements, such as, but not limited to, downhole pumps and/or flow separators, by connectors which provide fluid pressure integrity and transfer tensile loads.

In one embodiment, the spoolable pipe may be transported on a reel and connected to the downhole systems and devices. The complete system may be installed by spooling equipment which lowers the assembly into the well in a single operation. Similarly the complete assembly can be removed by spooling when required for maintenance or repair. Alternatively, the spoolable pipe may be deployed down a wellhole to be coupled to a pre-deployed downhole fluid control system.

Figure 6:
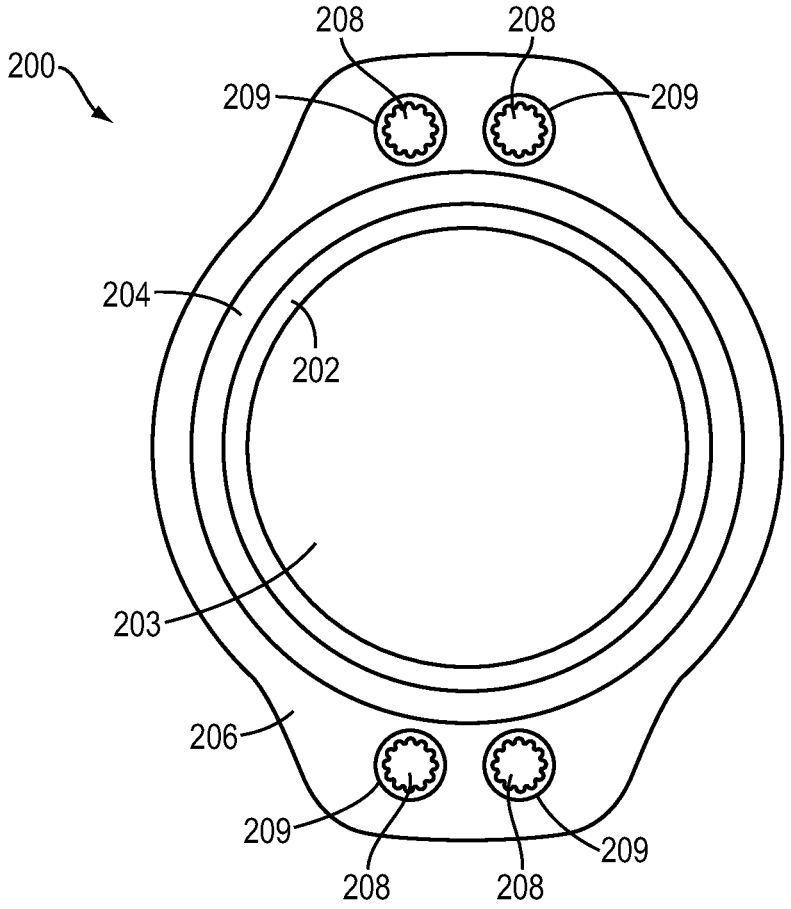
FIG. 6 is a cross-sectional view of a composite pipe with integrated energy conductors, in accordance with one embodiment of the invention.

An example spoolable pipe 200 for coupling to a downhole fluid control system is shown in FIG. 6. The spoolable pipe 200 includes a substantially fluid impervious inner barrier layer 202 enclosed by an intermediate composite layer 204. The inner barrier layer defines the boundary of an interior fluid channel 203. The composite layer 204 may include high strength fibers. An outer protective barrier layer 206 surrounds the composite layer 204. In an alternative embodiment, additional layers, such as additional intermediate composite layers and/or additional outer protection layers may be incorporated into the pipe 200.

The pipe 200 includes a plurality of energy conductors 208 embedded within the outer protective barrier layer 206. The energy conductors 208 are embedded within the outer protective barrier layer 206 substantially parallel with the elongate axis of the pipe 200. In an alternative embodiment, the energy conductors 208 are embedded substantially helically about the elongate axis of the pipe 200 within the outer protective barrier layer 206. In an alternative embodiment, one or more of the energy conductors 208 may be embedded within a different layer of the pipe 200, and/or be embedded between two layers of the pipe 200.

In one embodiment of the invention, each of the plurality of energy conductors may provide a different function for the downhole fluid control system. These functions may include, but are not limited to, providing power to a pump, fluid separation device, measurement device, and/or other downhole fluid control system element, provide a control signal to a pump, fluid separation device, measurement device, and/or other downhole fluid control system element, and/or provide a data conductor to transport a data signal from a pump, fluid separation device, measurement device, and/or other downhole fluid control system element to the top of the wellhole. The power conductor(s) may include an electrical power conductor and/or a hydraulic power conductor. In one embodiment, an electrical power conductor may be manufactured from copper.

The energy conductors 208 may, in one embodiment, include a cover 209. This cover 209 may provide protection for the energy conductors 208. In one embodiment, the covers 209 are color coded, or otherwise marked, to assist in the correct connection of each energy conductor 208 to its appropriate element.

In alternative embodiments of the invention, multiple energy conductors 208 may be adapted to provide the same function, thereby providing additional backup energy paths for one element of the downhole fluid control system. In one embodiment, one or more energy conductors 208 may be adapted to provide multiple functions, such as, but not limited to, providing a path for both a control signal to a downhole fluid control system element and providing a path for a data signal from the downhole fluid control system element back to the surface. In an alternative embodiment, a greater or lesser number of energy conductors 208 may be used. In further alternative embodiments, any appropriate combination of energy conductors may be integrated into the spoolable pipe 200.

Figure 7:
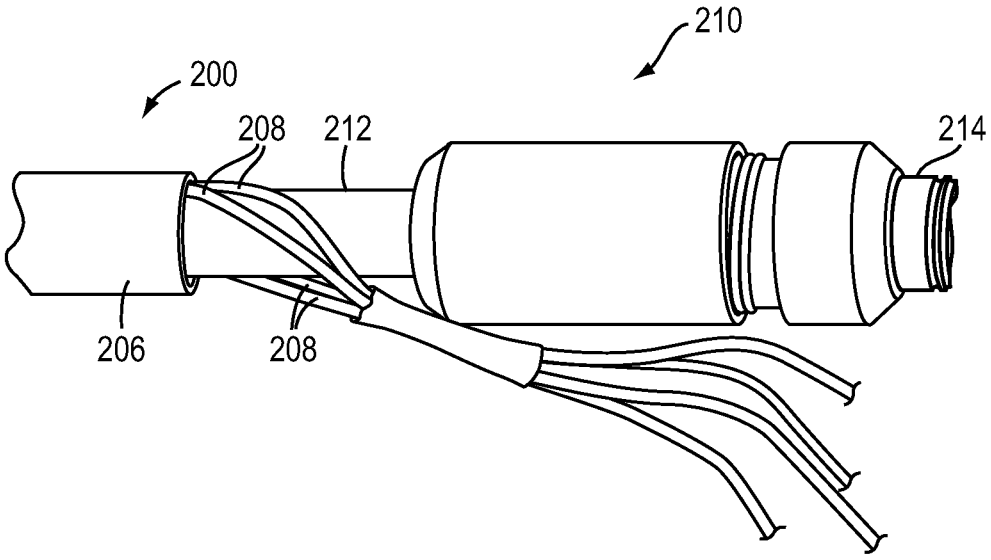
FIG. 7 is a side view of a connection device coupled to a composite pipe with integrated energy conductors, in accordance with one embodiment of the invention.

FIG. 7 shows an example connection device 210 coupled to a spoolable pipe 200 with integrated energy conductors 208. The connection device 210 includes a first connection end 212 adapted to mate with an end of the spoolable pipe 200. In one embodiment, as shown in FIG. 7, the first connection end 212 adapted to fit within the inner barrier layer 202 of the spoolable pipe 200. The fit between the spoolable pipe 200 and the first connection end 212 of the connection device 210 may be a pressure fitting, or may include a threaded, knurled, or other appropriate mating means.

The connection device 210 includes a second connection end 214 adapted to allow the connection device 210 to be coupled to another element such as, but not limited to, another spoolable pipe 200, a pump, a fluid separation device, or any other appropriate element. The second connection end 214 may include a threaded portion, a knurled portion, or any other appropriate mating element allowing the connection device 210 to be releasably connected.

The connection device 210 is configured to provide a fluid connection for the interior fluid channel 203, while allowing the energy conductors 208 to extend around the outside of the connection device 210. In an alternative embodiment, the connection device may include additional paths for extension of the energy conductors 208 therethrough.

Figure 8:
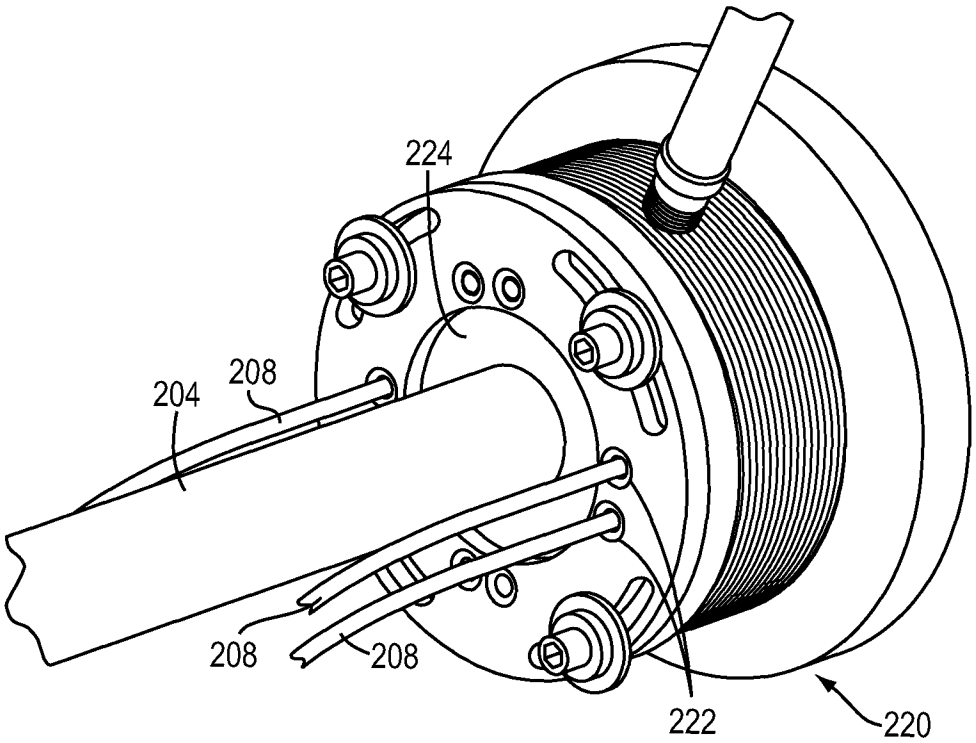
FIG. 8 is a perspective view of a mounting for a connection device for a composite pipe with integrated energy conductors, in accordance with one embodiment of the invention.

FIG. 8 shows an example mounting 220 for a composite pipe 200 with integrated energy conductors 208. The mounting 220 includes a plurality of paths 222 through which the energy conductors 208 may be passed, and a central path 224 through which the inner barrier layer 202, and possibly intermediate composite layer 204, that defines the interior fluid channel 203 may pass. In one embodiment, the composite pipe 200 may be coupled to a connection device 210 that is then releasably coupled to the mounting 220. In an alternative embodiment, the composite pipe 200 may be coupled directly to the mounting 220.

In use, the mounting 220 provides a means for coupling a distal end of the spoolable pipe 200 to a downhole fluid control system, such as, but not limited to, a pump, a DOWS and/or a DGWS. The mounting 220 also provides an example means of coupling a proximal end of the spoolable pipe 200 to a fluid control system, power system, and/or measurement system at the wellhead (i.e. at or near the surface of the wellhole). The mounting 220 may be adapted to be mounted to a structural support at the wellhead, thereby providing a stable anchor for the downhole fluid control system.

Figures 9A, 9B, 9C:
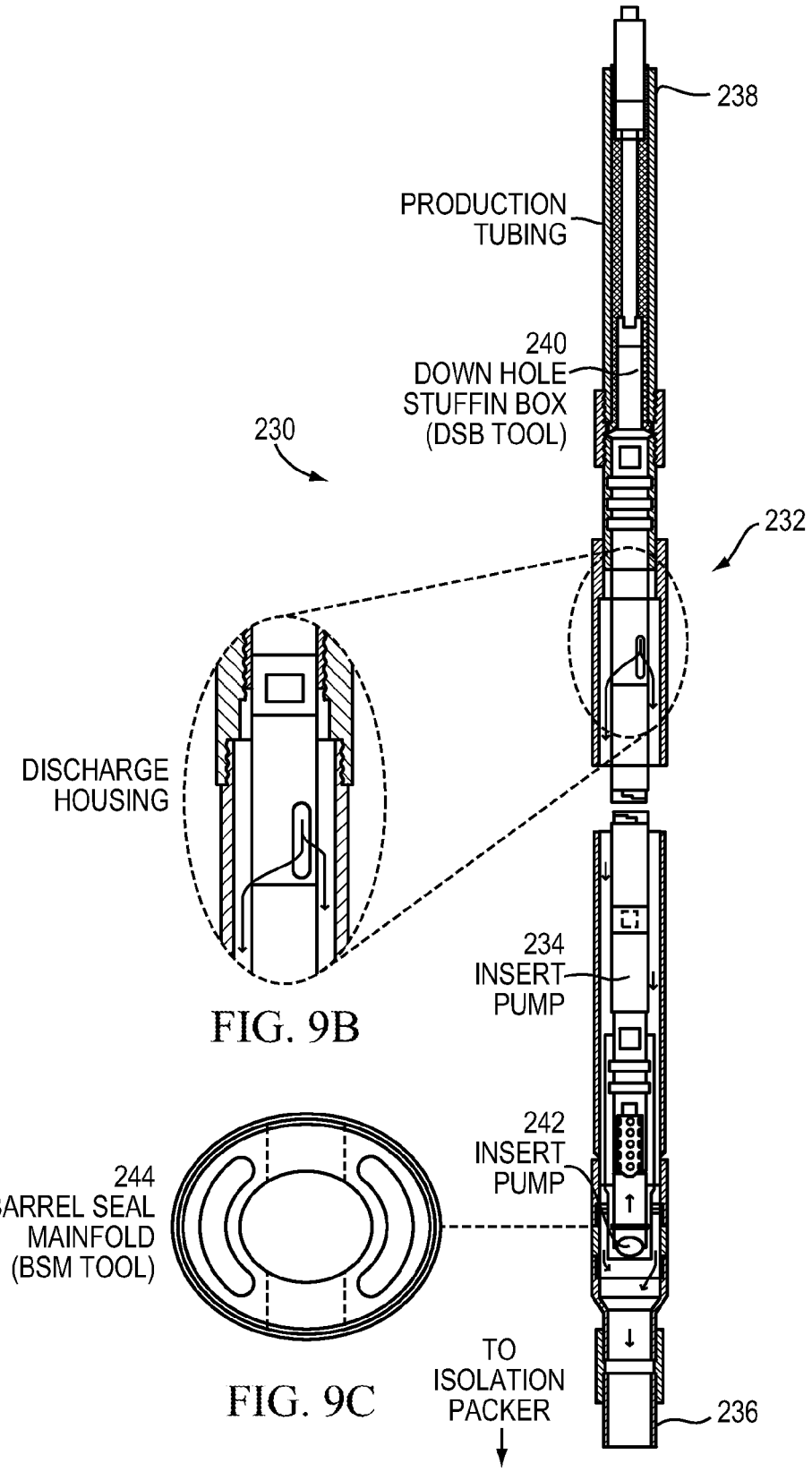
FIGS. 9A-9C include a schematic side view of a downhole fluid separation system and magnified views of a discharge housing and a barrel seal manifold, respectively, in accordance with one embodiment of the invention.

FIG. 9A shows an example downhole fluid separation system 230. The downhole fluid separation system 230 may be either a DOWS or a DGWS system, as appropriate. The downhole fluid separation system 230 includes an intake section 232 to provide an inlet for a fluid mixture trapped within a rock formation. For one example DGWS systems, the fluid mixture may then be separated out into the water-based fluid and the gas within the downhole fluid separation system 230. In one embodiment, one or more pumps are used to control the flow of the water-based fluid to the disposal zone. In another embodiment, gravity may be sufficient to enable flow/injection of water-based fluid into the disposal zone in the lower rock formation.

The water-based fluid is then transported, by a gravity and/or pump based mechanism to a discharge zone at a distal end 236 of the downhole fluid separation system 230. A pump 234, located near the distal end of the downhole fluid separation system 230, is then used to pump the water-based fluid through a pump intake 242 out of the distal end 236 of the downhole fluid separation system 230 into a disposal zone of the surrounding rock formation. A barrier seal manifold (BSM tool) 244 is located at the pump intake 242.

The gas, after being separated from the water-based fluid, passes upwards towards a proximal end 238 of the downhole fluid separation system 230 past a downhole stuffing box (DSB Tool) 240 and into a spoolable pipe 200 for transport to the surface. The downhole stuffing box 240 is used, for example to provide an axial seal around a rod string driving a downhole pump.

Figure 10:
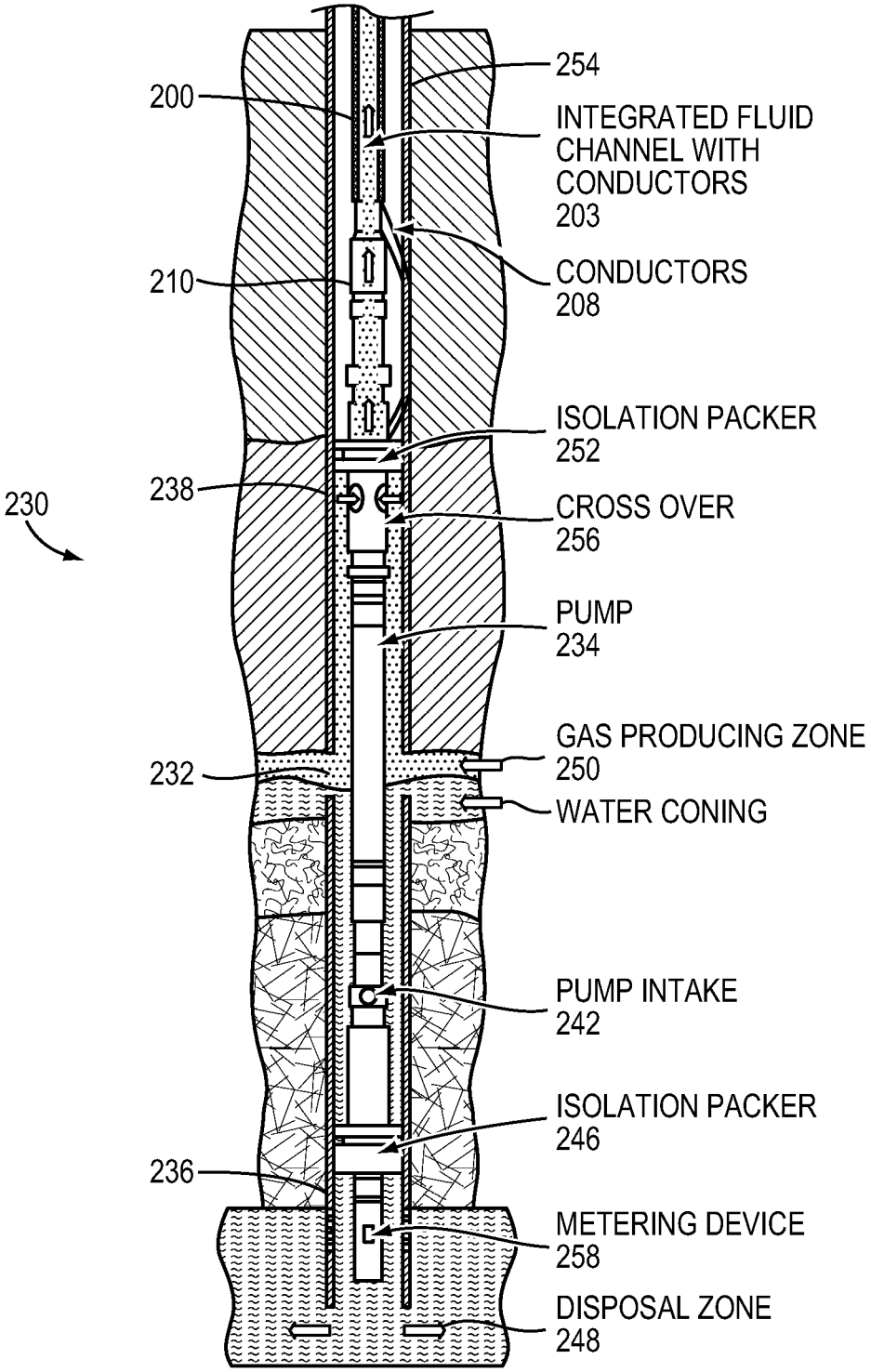
FIG. 10 is a schematic side view of a downhole fluid separation system in operation, in accordance with one embodiment of the invention.

FIG. 10 shows the downhole fluid separation system 230 for liquid/gas separation in operation. Upon deployment downhole (i.e. at a location at or near a distal end of a wellhole), the fluid mixture (e.g. a water/gas mixture for DGWS applications) is forced into an entrance port 232 of the downhole fluid separation system 230 at an intermediate distance along its length. Upon entering the downhole fluid separation system 230, the water-based fluid within the fluid mixture is driven (by gravity and/or pump action) down towards a distal end 236 of the downhole fluid separation system 230. The gas within the fluid mixture is then free to rise up to a proximal end 238 of the downhole fluid separation system 230 and pass into the fluid channel of the spoolable pipe 200 for transport to the surface. The gas may be transported to the surface through a gravity driven, pressure driven, and/or pump driven mechanism. In one embodiment, a separation device may be incorporated into the downhole fluid separation system 230 to assist with the separation of the gas from the water-based fluid. In an alternative embodiment, the gas may be separable from the water-based fluid, for example due to gravity and/or pressure, without the need for a separation device in the downhole fluid separation system 230.

An isolation packer 246 may be located near the distal end 236 of the downhole fluid separation system 230 to prevent the water-based fluid being discharged into the disposal zone 248 of the rock formation from flowing back up the wellhole.

In one embodiment, a metering device 258 may be placed at the distal end 236 of the downhole fluid separation system 230 to measure the volume of water-based fluid being injected into the disposal zone 248. As discussed above, this metering device 258 may be coupled to one or more energy conductors 208 of the spoolable pipe 200, thereby allowing the metering device 258 to communicate with a recording device at the surface, and/or be powered by a powering device at the surface.

In one embodiment of the invention, a second isolation packer 252 may be located at the proximal end 238 of the downhole fluid separation system 230 to prevent fluid flow up the wellhole in the annulus between the spoolable pipe 200 and the casing 254 of the wellhole, and thereby forcing the produced gas into the fluid channel 203 of the spoolable pipe 200 through the inlets ports 256 in a zonal isolation seal/cross-over at the proximal end 238 of the downhole fluid separation system 230 and through the coupling connector 210. This may be advantageous, for example, in embodiments where the produced gas is corrosive and would damage steel casing (outer most tubular). Corrosive materials may include, but are not limited to, gas with $CO_2$, $H_2S$, brines, moisture rich material, or other materials corrosive to metal used as standard in casing. In one embodiment, an area above the fluid producing zone, between the production piping and casing, may be filled with a fluid to protect the casing, e.g. a steel casing, from corrosion. In addition, since there may be corrosive fluids below the fluid producing zone, a liner may be used to protect the casing in that zone. In one embodiment, water, or another fluid, may be held within a discrete section of the wellhole above the gas producing zone by using additional isolation packers and/or cross-over devices. For example, in one embodiment a third isolation may be positioned above the second isolation packer 252, with a cross-over device providing fluid access thereto, such that water may be injected into a discrete section of the wellhole bounded by the second isolation packer 252 and third isolation packer. This may be of use, for example, in embodiments where the water-based fluid disposal zone is above the gas producing zone.

In an alternative embodiment, where it is acceptable for produced gas to flow up the annulus between the casing 254 and the spoolable pipe 200 (e.g. when the produced gas is non-corrosive), no upper isolation packer 252, or cross-over device, is required. In this embodiment, the gas may be allowed to flow up within the annulus between the casing 254 and the spoolable pipe 200 to the surface.

In one embodiment, the downhole fluid separation system may include additional elements, such as, but not limited to, sensors, valves, and/or power/date conduits. As described above, these sensors, valves, and/or power/date conduits may be control and/or powered by an energy signal transported to the element along one or more of the energy conductors integrated within the spoolable pipe and described herein. In one example embodiment, a fluid flow metering device is integrated into the downhole fluid separation system 230 to measure the quantity of fluid passing through the system 230. This metering device may be powered by, and communicate with, a surface device through one or more energy conductors 208.

In the embodiment of FIG. 10, the injection/disposal zone 248 for injection of the water-based fluid back into the rock formation is positioned below the liquid/gas producing zone 250. In an alternative embodiment, the water-based fluid injection zone 248 may be placed above the liquid/gas producing zone 250, for example in applications where the formation of the surrounding rock above the liquid/gas producing zone is better structured to receive the waste water-based fluid. In this embodiment, additional zonal isolation seals, or cross-overs, may be required.

One embodiment of the invention may include a downhole fluid separation system coupled to a spoolable pipe with integrated energy conductors that may be used for deep wells (i.e. wells extending up to, or more than, 10,000 ft from the surface. Such deep well configurations may include spoolable pipe that incorporates selective reinforcement of the pipe structure to maintain the integrity of the pipe over extended distances, and to allow the pipe to support its own weight, the weight of the fluid passing therein, and possible even the weight of the downhole fluid separation system to which it is coupled.

For example, in one embodiment selectively applied reinforcement may be incorporated into the composite pipe to carry the additional tensile load provided by the weight of the conductors in a vertical application. This selective reinforcement may include, but is not limited to, strengthening elements (such as, but not limited to, ribs, wires, filaments, fibers, or other appropriate elongate strengthening elements) of the same, or different, materials to that of the pipe layers that may extend along an inner and/or outer surface of the pipe, and/or between different layers of the pipe. The reinforcement may extend substantially parallel with an elongate axis of the pipe, and/or be helically wound around the pipe.

The materials for these selective reinforcement elements may include, but are not limited to metal (such as, but not limited to, steel), composite materials, Kevlar™, graphite, boron, or any other appropriate material described herein. This selective reinforcement may be added along the entire length of the spoolable pipe, or along only a portion thereof.

In one embodiment, the spoolable pipe may incorporate lighter materials along its length, or a portion of its length (e.g. a distal end section of the length of the spoolable pipe) to minimize the weight of the pipe, thereby reducing the load on the pipe as it is deployed downhole. Example materials include, but are not limited to, carbon fiber. These lighter materials may be utilized along with, or in place of, reinforcement elements to provide a spoolable pipe with energy conductors that have sufficient strength and structural integrity to be used in deep hole applications.

In one embodiment, appropriate bonding methods may be utilized to ensure sufficient load transfer between the energy conductor(s) and the pipe to allow the pipe to sufficient support the energy conductor(s), thereby preventing damage to the energy conductor(s) during deployment and use. For example, in one embodiment, the selective reinforcement may be adapted to closely match the stress/strain curve of the energy conductor(s) to ensure that there is no relative movement between the pipe and the power cables which could lead to failure or damage of either component.

All publications and patents mentioned herein, including those items listed below, are hereby incorporated by reference in their entirety as if each individual publication or patent was specifically and individually incorporated by reference. In case of conflict, the present application, including any definitions herein, will control.

This application is related to U.S. Pat. No. 6,016,845, U.S. Pat. No. 6,148,866, U.S. Pat. No. 6,286,558, U.S. Pat. No. 6,357,485, U.S. Pat. No. 6,604,550, U.S. Pat. No. 6,857,452, U.S. Pat. No. 5,921,285, U.S. Pat. No. 5,176,180, U.S. Pat. No. 6,004,639, U.S. Pat. No. 6,361,299, U.S. Pat. No. 6,706,348, U.S. Pat. No. 6,663,453, U.S. Pat. No. 6,764,365, U.S. Pat. No. 7,029,356, U.S. Pat. No. 7,234,410, U.S. Pat. No. 7,285,333, and U.S. Pat. No. 7,498,509. This application is also related to US Patent Publication Nos. US2005/0189029, US2007/0125439, US2008/0720029, US2008/0949091, US2008/0721135, and US2009/0278348. All publications and patents mentioned herein, including those items listed above, are hereby incorporated by reference in their entirety as if each individual publication or patent was specifically and individually incorporated by reference. In case of conflict, the present application, including any definitions herein, will control.

While specific embodiments of the subject invention have been discussed, the above specification is illustrative and not restrictive. Many variations of the invention will become apparent to those skilled in the art upon review of this specification. The full scope of the invention should be determined by reference to the claims, along with their full scope of equivalents, and the specification, along with such variations.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that may vary depending upon the desired properties sought to be obtained by the present invention.

The terms "a" and "an" and "the" used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided herein is intended merely to better illuminate the invention and does not pose a limitation on the scope of the invention otherwise claimed. No language in the specification should be construed as indicating any non-claimed element essential to the practice of the invention.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A system for operating, monitoring and controlling pumps at a below ground location in a wellhole, comprising:

a spoolable composite pipe comprising a fluid channel defined by a composite layer enclosing a substantially fluid impervious inner layer and at least one energy conductor;

at least one fluid separation device comprising at least one pump and adapted to separate a fluid mixture into at least one first fluid and at least one second fluid, wherein the at least one first fluid is directed into the fluid channel of the spoolable composite pipe and the at least one second fluid is directed into an underground formation; and a distal mounting comprising a central path and at least one outer path, the distal mounting adapted to (i) couple a distal end of the fluid channel to the at least one pump by passing the composite layer and the inner layer completely through the central path and (ii) couple a distal end of the at least one energy conductor to the at least one fluid separation device by extending the at least one conductor completely through the at least one outer path exclusive of the central path.

2. The system of claim 1, wherein the energy conductor comprises at least one of a power conductor or a data conductor.

3. The system of claim 2, wherein the power conductor comprises at least one of an electrical power conductor or a hydraulic power conductor.

4. The system of claim 2, wherein the data conductor comprises at least one of a fiber-optic cable or an electrically conductive cable.

5. The system of claim 1, wherein the spoolable composite pipe comprises:

an outer protective layer enclosing the composite layer and inner liner, wherein the composite layer comprises high strength fibers.

6. The system of claim 5, wherein the at least one energy conductor is at least one of (i) embedded within at least one layer of the spoolable composite pipe, (ii) helically wound around at least one inner layer of the spoolable composite pipe, or (iii) extended substantially parallel with an elongate axis of the spoolable composite pipe.

7. The system of claim 1, wherein the spoolable composite pipe comprises at least one reinforcing element.

8. The system of claim 1, wherein the at least one fluid separation device further comprises at least one of a measurement device or a communication device.

9. The system of claim 8, wherein the measurement device comprises at least one of a flow meter, a pressure meter, a temperature meter, a stress meter, a strain gauge, and a chemical composition measuring device.

10. A method of separating fluids at a below ground location in a wellhole, comprising:

positioning at least one separation device comprising at least one pump at a below ground location in a wellhole;

connecting the at least one separation device to an above-ground location through a spoolable composite pipe comprising a fluid channel defined by a composite layer enclosing a substantially fluid impervious inner layer and at least one energy conductor via a distal mounting comprising a central path and at least one outer path, the distal mounting adapted to couple a distal end of the fluid channel to the at least one pump by passing the composite layer and the inner layer completely through the central path;

providing at least one of a power supply or a control signal to the at least one separation device through the at least one energy conductor extending completely through the at least one outer path exclusive of the central path;

passing a fluid mixture through the at least one fluid separation device;

separating the fluid mixture into at least one first fluid and at least one second fluid;

pumping the first fluid to the surface through the fluid channel; and releasing the second fluid to an underground formation.

11. The method of claim 10, wherein the first fluid comprises at least one of oil-rich fluid and a gas-rich fluid.

12. The method of claim 10, wherein the second fluid comprises a water-rich fluid.

13. The method of claim 10, wherein the at least one fluid separation device is connected to the spoolable composite pipe prior to positioning the at least one fluid separation device at the below ground location in the wellhole.

14. The method of claim 10, wherein the energy conductor comprises at least one of a power conductor and a data conductor.

15. The method of claim 10, wherein both power supply and control signals are provided to the at least one fluid separation device through separate energy conductors.

16. The method of claim 10, wherein the spoolable composite pipe further comprises an outer protective layer enclosing the composite layer and inner liner.

17. The method of claim 10, further comprising measuring at least one property of the fluid mixture passing through the at least one fluid separation device.

18. The method of claim 17, wherein the measuring step comprises measuring at least one of a flow rate, a pressure, a temperature, a stress, a strain, or a chemical composition.

* * * * *